US009303583B2

(12) United States Patent
Surnilla et al.

(10) Patent No.: US 9,303,583 B2
(45) Date of Patent: Apr. 5, 2016

(54) ROBUST DIRECT INJECTION FUEL PUMP SYSTEM

(71) Applicant: Ford Global Technologies, LLC, Dearborn, MI (US)

(72) Inventors: Gopichandra Surnilla, West Bloomfield, MI (US); Ross Dykstra Pursifull, Dearborn, MI (US); Mark Meinhart, South Lyon, MI (US); Joseph F. Basmaji, Waterford, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 298 days.

(21) Appl. No.: 14/155,250

(22) Filed: Jan. 14, 2014

(65) Prior Publication Data

US 2015/0198081 A1 Jul. 16, 2015

(51) Int. Cl.

| | |
|---|---|
| ***F02B 17/00*** | (2006.01) |
| ***F02D 41/38*** | (2006.01) |
| ***F02D 41/30*** | (2006.01) |
| ***F02M 63/02*** | (2006.01) |

(52) U.S. Cl.

CPC ..... *F02D 41/3845* (2013.01); *F02D 41/3094* (2013.01); *F02D 41/3854* (2013.01); *F02M 63/029* (2013.01); *F02D 2041/389* (2013.01); *F02D 2041/3881* (2013.01); *F02D 2250/02* (2013.01)

(58) Field of Classification Search

CPC . F02B 17/00; F02D 41/3094; F02D 41/3836; F02D 41/30; F02D 2200/0602; F02D 2250/31; F02M 37/20

USPC ..... 123/294, 295, 299, 305, 445–447, 458, 123/495, 497, 502; 701/103, 104

See application file for complete search history.

(56) References Cited

U.S. PATENT DOCUMENTS

| | | | |
|---|---|---|---|
| 6,053,036 | A | 4/2000 | Uto et al. |
| 7,216,627 | B2 | 5/2007 | Ito et al. |
| 7,272,485 | B2 | 9/2007 | Amano et al. |
| 7,281,517 | B2 | 10/2007 | Miyazaki et al. |
| 7,426,919 | B2 | 9/2008 | Kano et al. |
| 7,448,367 | B1 | 11/2008 | Reddy et al. |

(Continued)

FOREIGN PATENT DOCUMENTS

CN 103016335 A 4/2013

OTHER PUBLICATIONS

"Hydraulic Accumulator," http://en.wikipedia.org/wiki/Hydraulic_accumulator, Wikipedia, Accessed Feb. 4, 2014, 5 pages.

(Continued)

*Primary Examiner* — John Kwon
*Assistant Examiner* — Johnny H Hoang
(74) *Attorney, Agent, or Firm* — Julia Voutyras; Alleman Hall McCoy Russell & Tuttle LLP

(57) ABSTRACT

A method for a PFDI engine may comprise, during a first condition, comprising direct-injecting fuel to the PFDI engine, estimating a fuel vapor pressure, and setting a fuel lift pump pressure greater than the fuel vapor pressure by a threshold pressure difference, and during a second condition, comprising port-fuel-injecting fuel to the PFDI engine, setting a DI fuel pump command signal greater than a threshold DI fuel pump command signal without supplying fuel to a DI fuel rail.

20 Claims, 7 Drawing Sheets

(56) References Cited

U.S. PATENT DOCUMENTS

| | | | | |
|---|---|---|---|---|
| 7,552,720 | B2 | 6/2009 | Borg et al. | |
| 7,640,916 | B2 | 1/2010 | Ulrey et al. | |
| 7,720,592 | B2 * | 5/2010 | Leone | F02B 17/005 123/575 |
| 7,832,375 | B2 | 11/2010 | Dusa et al. | |
| 7,966,984 | B2 | 6/2011 | Ulrey et al. | |
| 8,061,329 | B2 | 11/2011 | Pursifull et al. | |
| 2005/0005912 | A1 * | 1/2005 | Joos | F02D 41/222 123/458 |
| 2005/0199219 | A1 * | 9/2005 | Utsumi | F02D 41/22 123/458 |
| 2006/0075992 | A1 * | 4/2006 | Akita | F02D 41/3094 123/431 |
| 2009/0090331 | A1 | 4/2009 | Pursifull | |
| 2009/0320796 | A1 * | 12/2009 | Kojima | F02M 55/04 123/447 |
| 2012/0048242 | A1 * | 3/2012 | Surnilla | F02M 39/02 123/497 |
| 2012/0328452 | A1 * | 12/2012 | Surnilla | F02M 37/0064 417/1 |
| 2013/0144507 | A1 | 6/2013 | Lee | |

OTHER PUBLICATIONS

Pursifull, Ross D. et al., "Direct Injection Fuel Pump," U.S. Appl. No. 13/830,022, filed Mar. 14, 2013, 50 pages.

* cited by examiner

ROBUST DIRECT INJECTION FUEL PUMP SYSTEM

BACKGROUND AND SUMMARY

Port fuel direct injection (PFDI) engines are capable of advantageously utilizing both port injection and direct injection of fuel. For example, at higher engine loads, fuel may be injected into the engine using direct fuel injection, thereby improving engine performance (e.g., increasing available torque and fuel economy). At lower engine loads, fuel may be injected into the engine using port fuel injection, thereby reducing vehicle emissions, NVH, and wear of the direct injection system components, (e.g., injectors, DI pump solenoid valve, and the like). In PFDI engines, the low pressure fuel pump supplies fuel from the fuel tank to both the port fuel injectors and the direct injection fuel pump. Because there may be periods of engine operation during which the direct injection fuel pump may not be running (e.g., during port fuel injection at low engine loads), lubrication of the DI fuel pump may not be maintained and wear, NVH and degradation of the DI fuel pump may be increased.

Conventional methods of operating PFDI engines may include direct injecting fuel at engine idle conditions in order to maintain lubrication of the direct injection fuel pump. Furthermore, in some PFDI engines, the low pressure fuel pump may be operated at excessive power levels in order to ensure robust supply of fuel to the direct injection pump and in order to mitigate direct injection pump cavitation. Other methods of operating PFDI engines attempt to optimize the low pressure fuel pump power consumption.

The inventors herein have recognized potential issues with the above approaches. First, because the direct injection fuel pump may not be used at low and idle engine loads in PFDI engines, pump lubrication may be reduced, thereby accelerating pump degradation. Furthermore, operating the direct injection pump during engine idle conditions can result in excessive NVH due to ticks generated by the DI fuel pump and due to a lack of engine noise to mask the pump noise. Second, conventional methods of controlling the low pressure fuel pump expend excessive pump power, thereby reducing fuel economy and pump durability, or do not robustly deliver fuel to the direct injection fuel pump, thereby causing pump cavitation, which may reduce engine performance and aggravate injection pump degradation.

One approach that at least partially overcomes the above issues and achieves the technical result of increasing direct injection pump durability without increasing NVH, and increasing robustness of fuel delivery to the direct injection fuel pump while reducing power consumption and without reducing low pressure pump durability, includes a method for a PFDI engine, during a first condition, comprising direct-injecting fuel to the PFDI engine, estimating a fuel vapor pressure, and setting a fuel lift pump pressure greater than the fuel vapor pressure by a threshold pressure difference, and during a second condition, comprising port-fuel-injecting fuel to the PFDI engine, setting a DI fuel pump duty cycle to a threshold duty cycle without supplying fuel to a DI fuel rail.

In another embodiment, a method of operating a fuel system for an engine comprises maintaining a fuel lift pump pressure greater than an estimated fuel vapor pressure while fuel is being direct-injected to the engine, and enforcing a DI fuel pump duty cycle above a threshold duty cycle even when fuel is not being direct-injected to the engine.

In another embodiment, an engine system comprises a PFDI engine, a DI fuel pump, a fuel lift pump, and a controller, comprising executable instructions to during a first condition, comprising direct-injecting fuel to the PFDI engine, estimating a fuel vapor pressure, and setting a pressure of the fuel lift pump greater than the fuel vapor pressure by a threshold pressure difference, and during a second condition, comprising port-fuel-injecting fuel to the PFDI engine, setting a DI fuel pump duty cycle to a threshold duty cycle without supplying fuel to a DI fuel rail.

In this way, DI fuel pump cavitation can be reduced, enabling the DI fuel pump to maintain operation at full volumetric efficiency while reducing lift pump power and thereby increasing robustness of DI fuel pump operation. Furthermore, DI fuel pump NVH and degradation of the DI fuel pump may be reduced.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
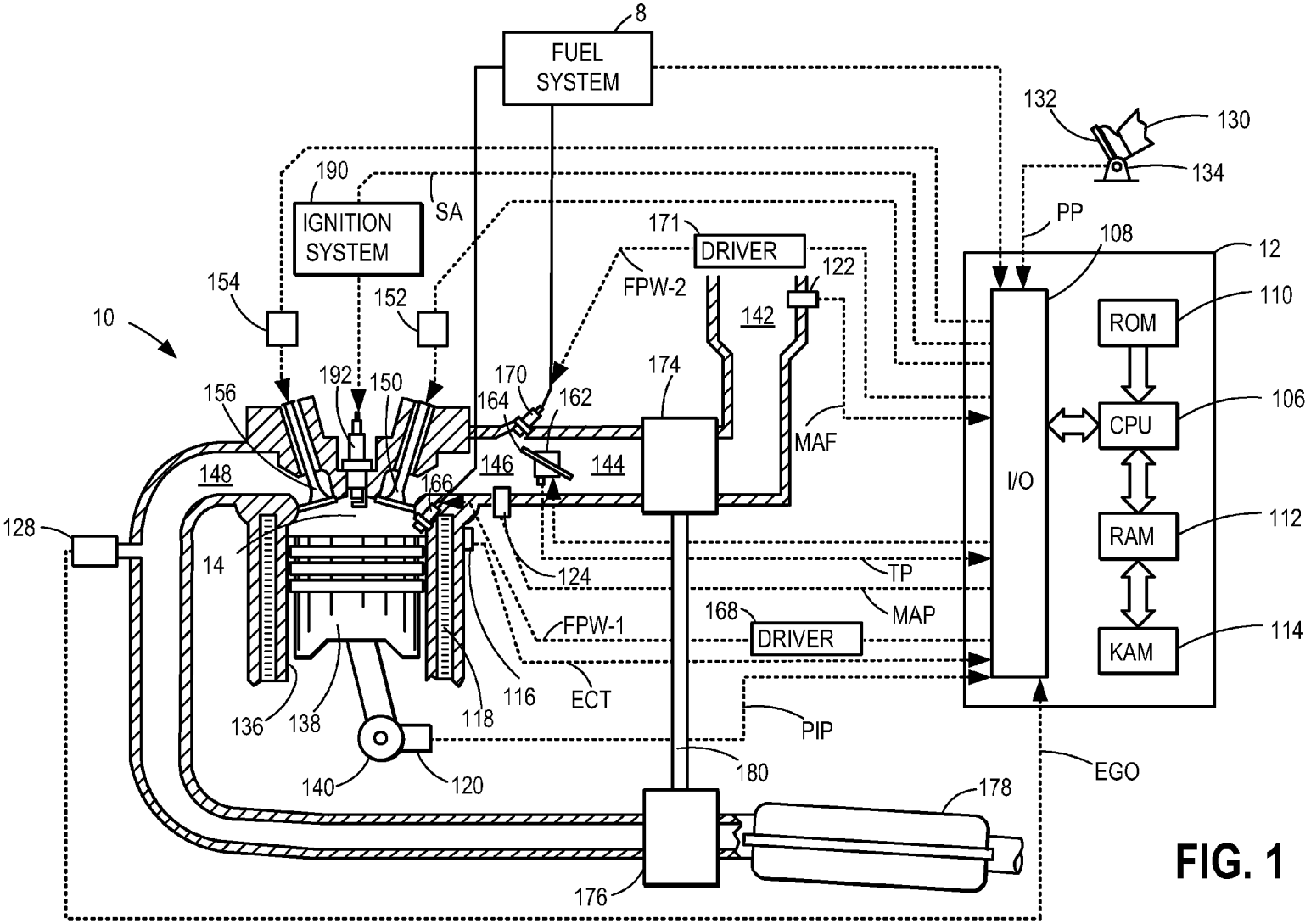
FIG. 1 shows an example of a port fuel direct injection engine.
Figure 2:
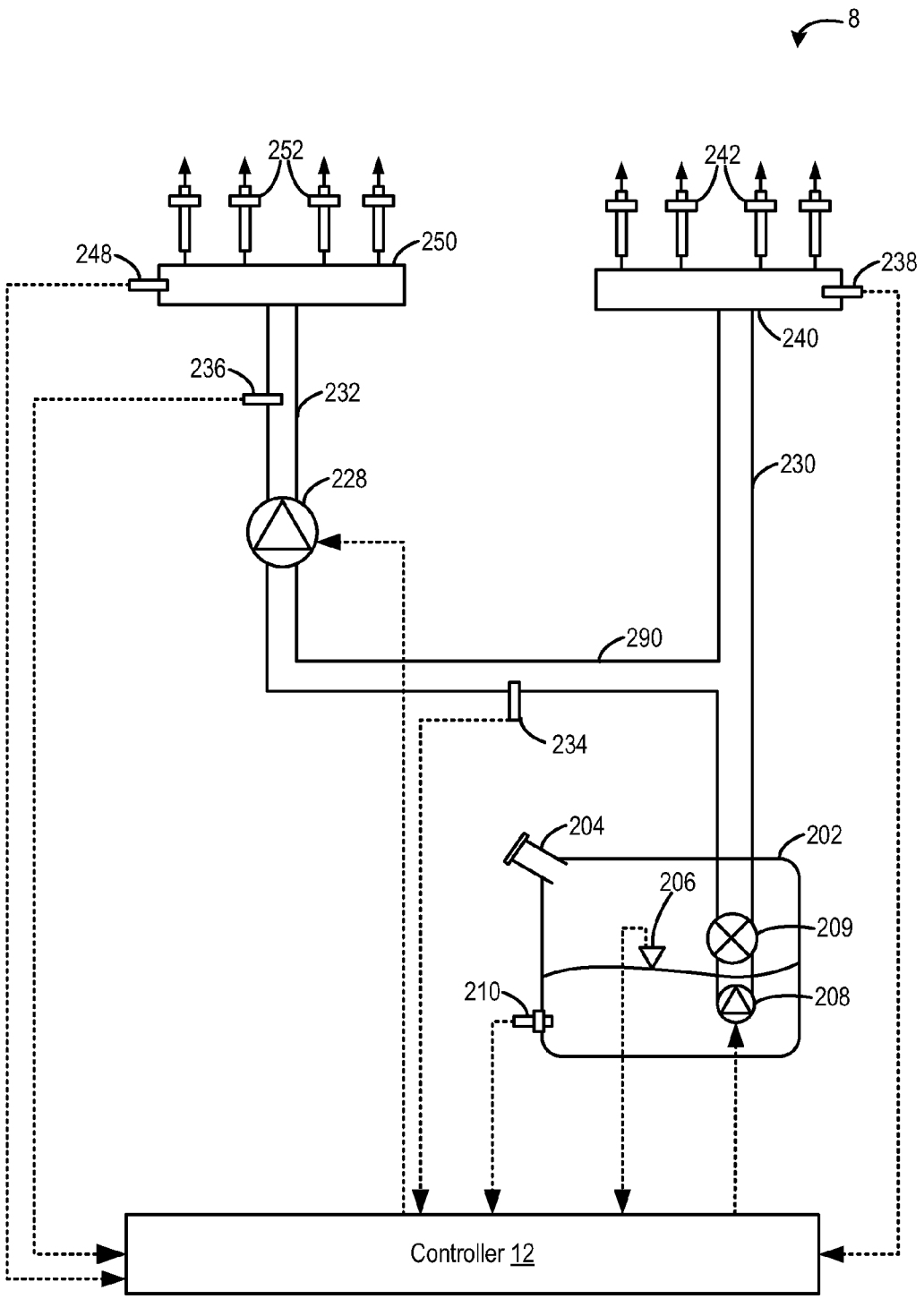
FIG. 2 shows an example of a fuel system that may be used with the port fuel direct injection engine of FIG. 1.
Figure 3A:
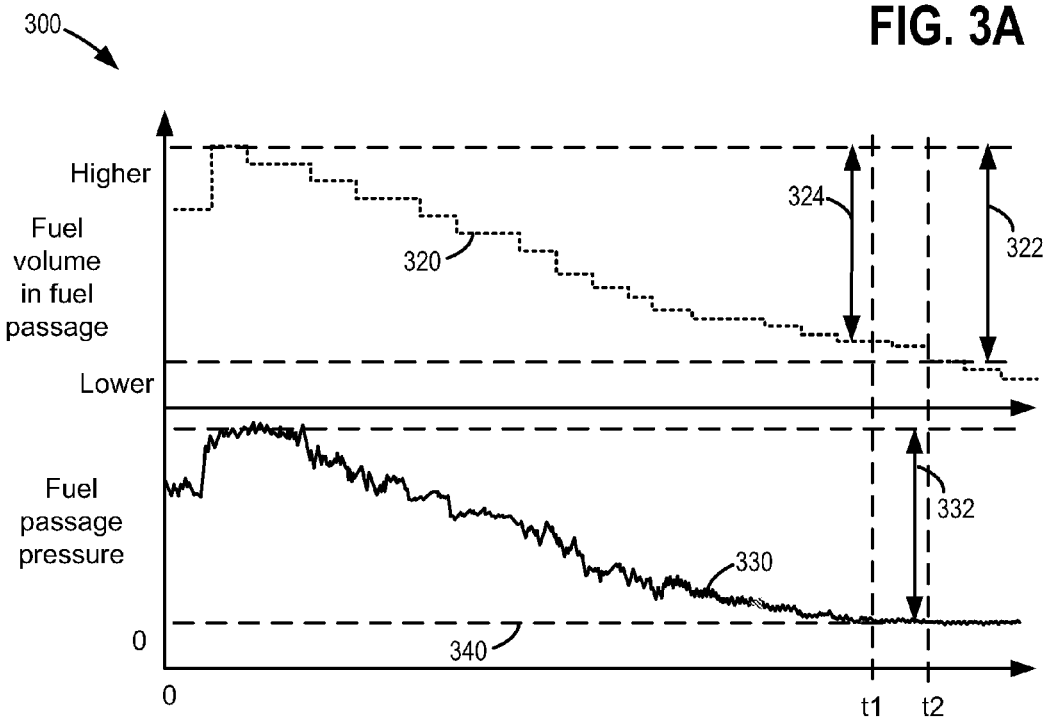
FIG. 3A is an example plot illustrating low pressure fuel pump pressure and fuel vapor pressure.
Figure 3B:
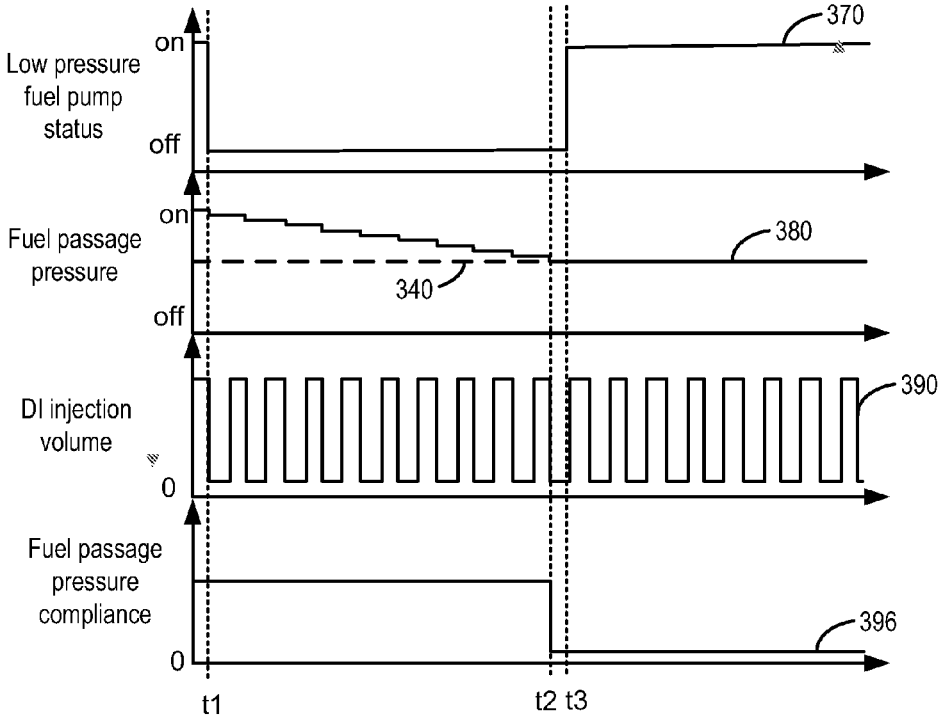
FIG. 3B is an example timeline illustrating operation of a port fuel direct injection engine.
Figure 4:
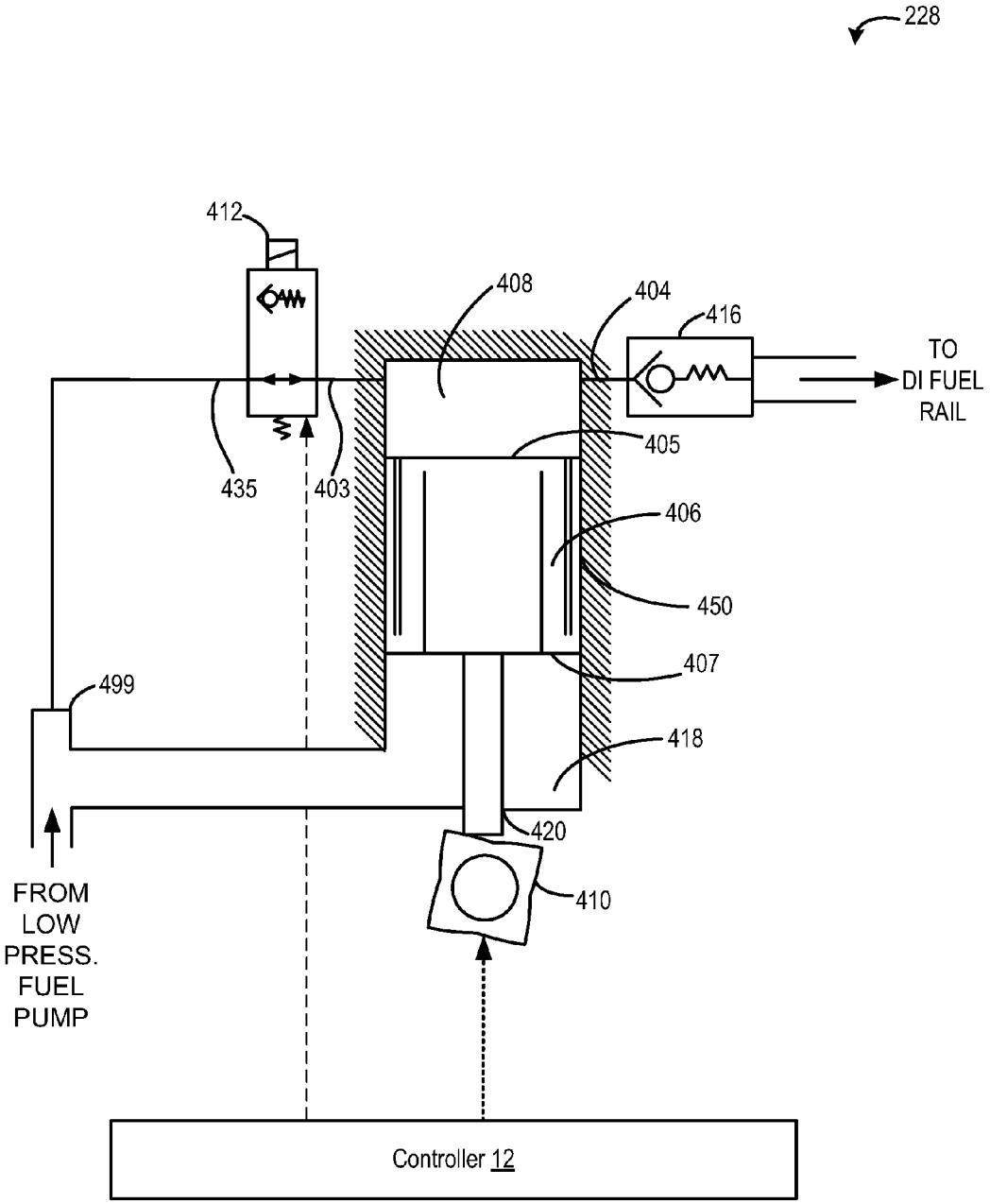
FIG. 4 is a schematic of an example of a direct injection fuel pump.
Figure 5:
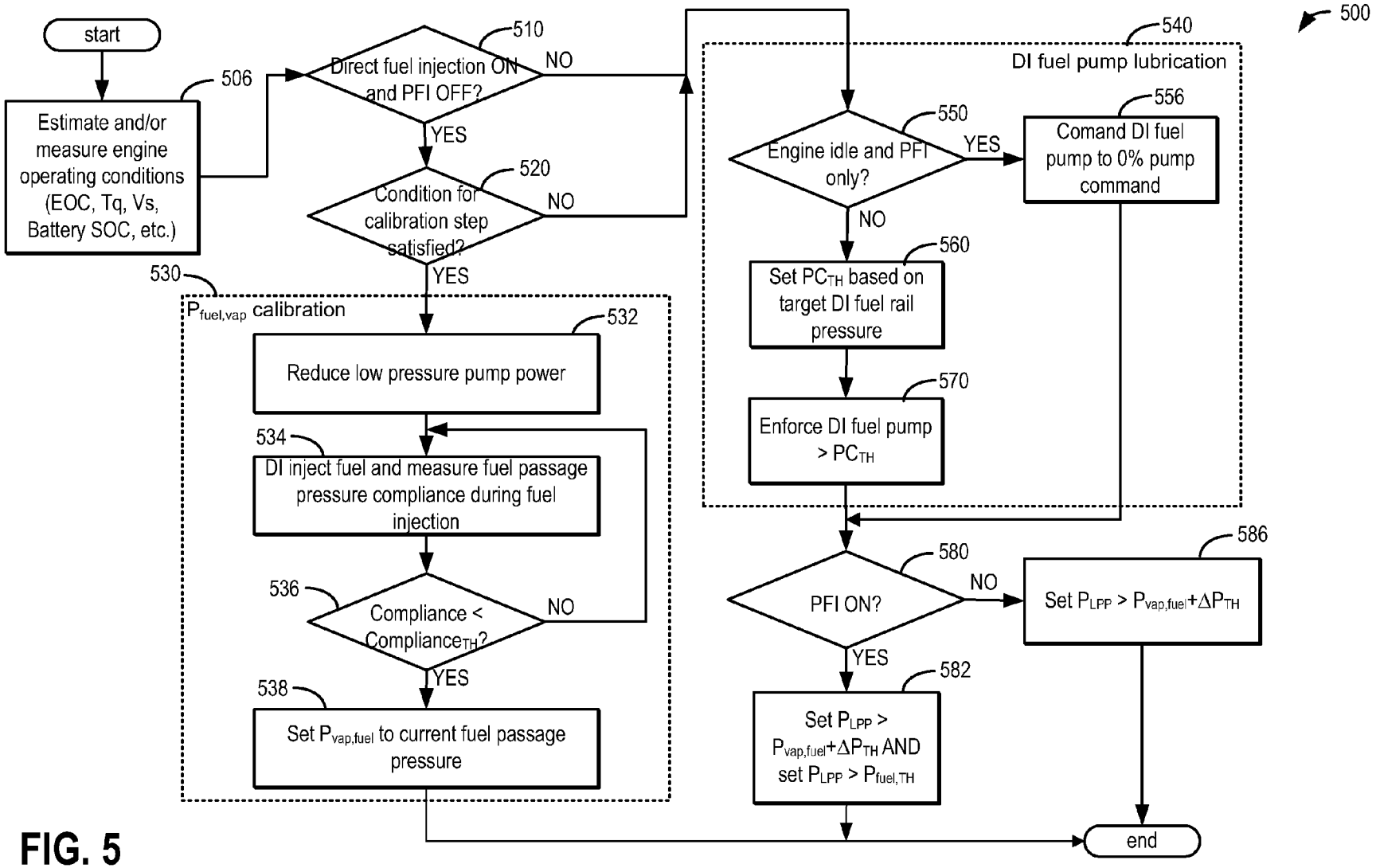
FIG. 5 is an example flow chart of a method of operating a port fuel direct injection engine.
Figure 6:
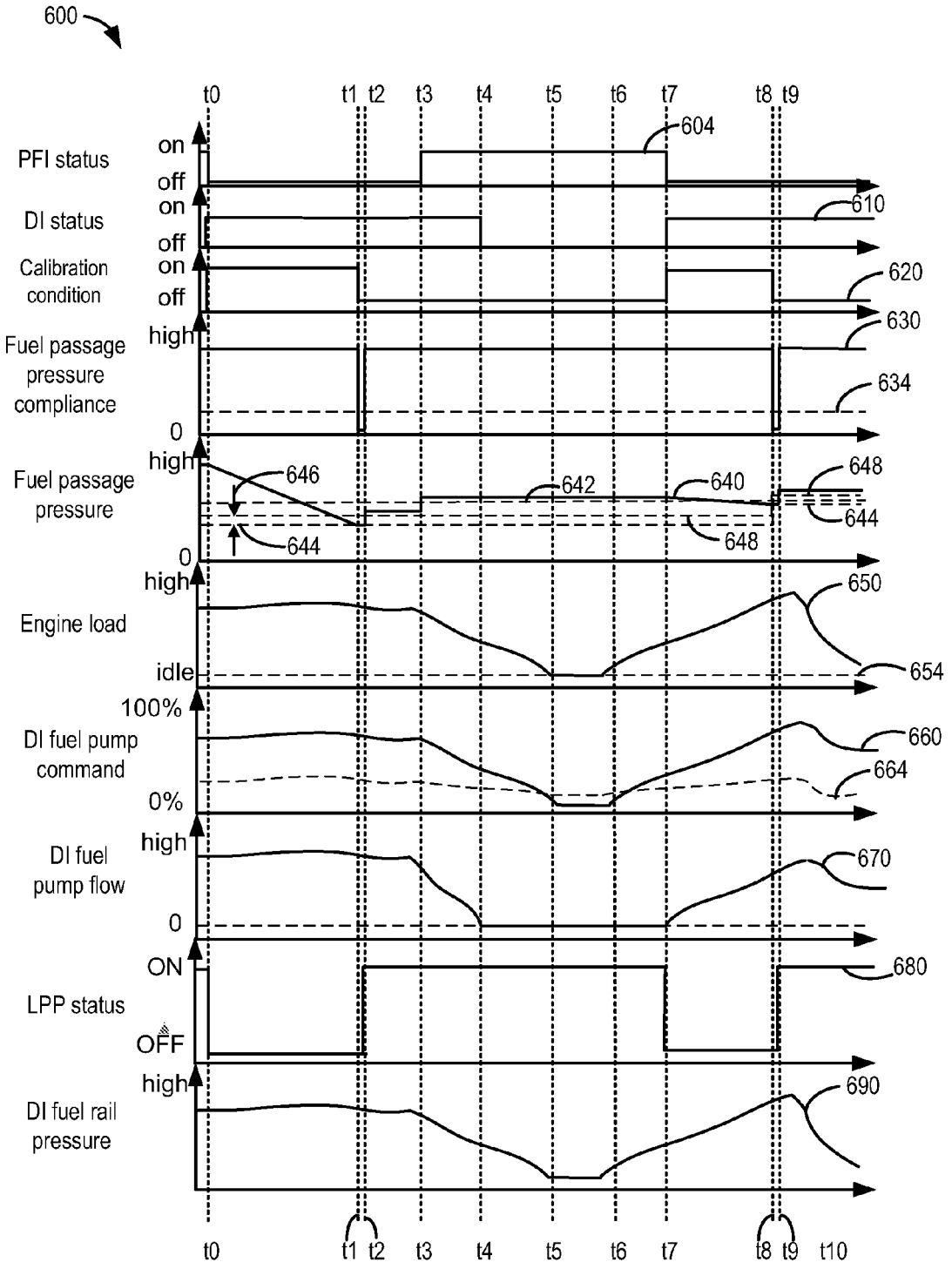
FIG. 6 is an example timeline illustrating operation of a port fuel direct injection engine.
Figure 7:
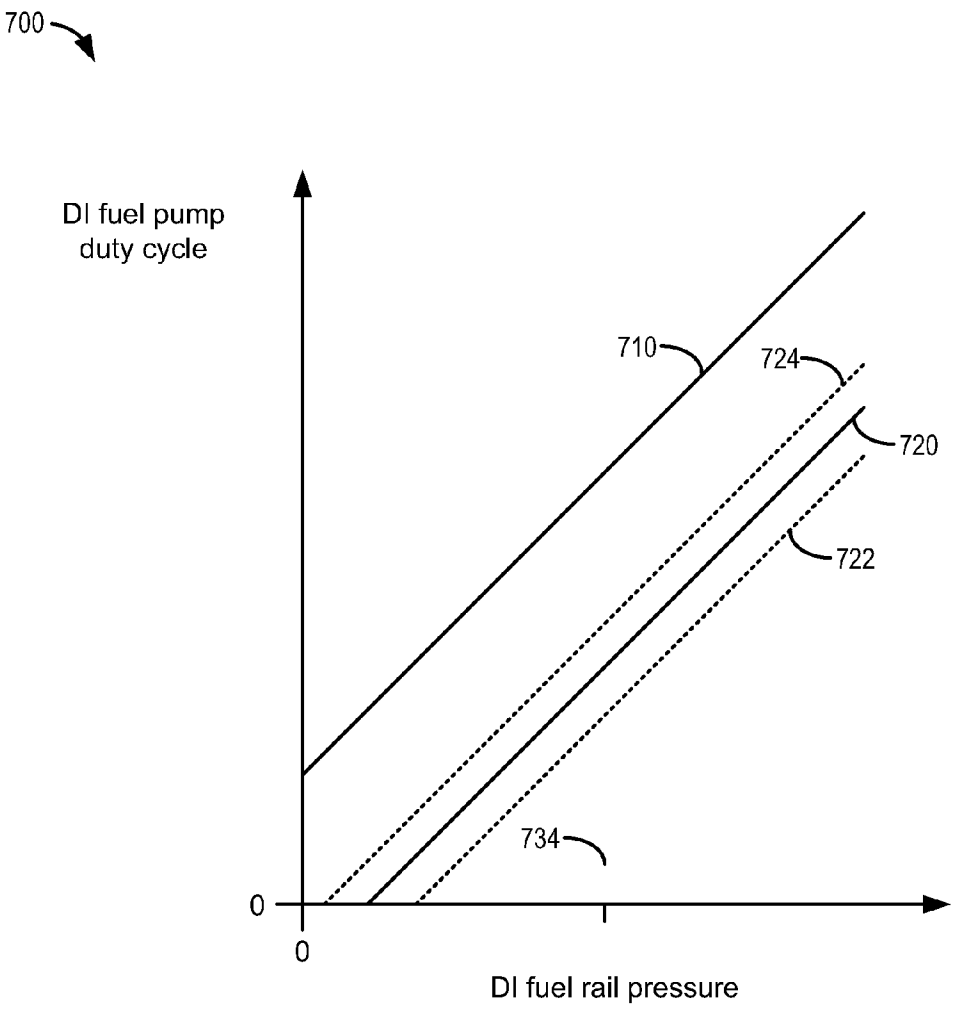
FIG. 7 is an example plot of DI fuel pump duty cycle versus DI fuel rail pressure.

The following disclosure relates to methods and systems for operating a port fuel direct injection (PFDI) engine, such as the engine system of FIG. 1. The fuel system of a PFDI engine, as illustrated in FIG. 2, may be configured to deliver one or more different fuel types to an internal combustion engine, such as the engine of FIG. 1. A direct injection fuel pump as shown in FIG. 4 may be incorporated into the systems of FIGS. 1 and 2. The port fuel direct injection engine may operate as shown in FIGS. 3B and 6 according to a method as illustrated in FIG. 5. FIG. 3A is an example plot illustrating pressure in a fuel passage pressure and fuel volume in the fuel passage. FIG. 7 is an example plot of DI fuel pump duty cycle versus DI fuel rail pressure.

Turning to FIG. 1, it depicts an example of a combustion chamber or cylinder of internal combustion engine 10. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder (herein also "combustion chamber") 14 of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor (not shown) may be coupled to crankshaft 140 via a flywheel to enable a starting operation of engine 10.

Cylinder 14 can receive intake air via a series of intake air passages 142, 144, and 146. Intake air passage 146 can communicate with other cylinders of engine 10 in addition to cylinder 14. In some examples, one or more of the intake air passages may include a boosting device such as a turbocharger or a supercharger. For example, FIG. 1 shows engine 10 configured with a turbocharger including a compressor 174 arranged between intake air passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 162 including a throttle plate 164 may be provided along an intake passage of the engine for varying the flow rate and/or pressure of intake air provided to the engine cylinders. For example, throttle 162 may be positioned downstream of compressor 174 as shown in FIG. 1, or alternatively may be provided upstream of compressor 174.

Exhaust passage 148 can receive exhaust gases from other cylinders of engine 10 in addition to cylinder 14. Exhaust gas sensor 128 is shown coupled to exhaust passage 148 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder.

Intake poppet valve 150 may be controlled by controller 12 via actuator 152. Similarly, exhaust poppet valve 156 may be controlled by controller 12 via actuator 154. During some conditions, controller 12 may vary the signals provided to actuators 152 and 154 to control the opening and closing of the respective intake and exhaust valves. The position of intake poppet valve 150 and exhaust poppet valve 156 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 14 may alternatively include an intake valve controlled via electric valve actuation and an exhaust valve controlled via cam actuation including CPS and/or VCT. In other examples, the intake and exhaust valves may be controlled by a common valve actuator or actuation system, or a variable valve timing actuator or actuation system.

Cylinder 14 can have a compression ratio, which is the ratio of volumes when piston 138 is at bottom center to top center. In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder 14 of engine 10 may include a spark plug 192 for initiating combustion. Ignition system 190 can provide an ignition spark to combustion chamber (e.g., cylinder 14) via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some examples, each cylinder of engine 10 may be configured with one or more fuel injectors for providing fuel thereto. As a non-limiting example, cylinder 14 is shown including two fuel injectors 166 and 170. Fuel injectors 166 and 170 may be configured to deliver fuel received from fuel system 8. As elaborated with reference to FIGS. 2 and 3, fuel system 8 may include one or more fuel tanks, fuel pumps, and fuel rails. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 14. While FIG. 1 shows fuel injector 166 positioned to one side of cylinder 14, it may alternatively be located overhead of the piston, such as near the position of spark plug 192. Such a position may enhance mixing and combustion when operating the engine with an alcohol-based fuel due to the lower volatility of some alcohol-based fuels. Alternatively, the injector may be located overhead and near the intake valve to increase mixing. Fuel may be delivered to fuel injector 166 from a fuel tank of fuel system 8 via a high pressure fuel pump, and a fuel rail. Further, the fuel tank may have a pressure transducer providing a signal to controller 12.

Fuel injector 170 is shown arranged in intake passage 146, rather than in cylinder 14, in a configuration that provides what is known as port injection of fuel (hereafter referred to as "PFI") into the intake port upstream of cylinder 14. Fuel injector 170 may inject fuel, received from fuel system 8, in proportion to the pulse width of signal FPW-2 received from controller 12 via electronic driver 171. Note that a single driver 168 or 171 may be used for both fuel injection systems, or multiple drivers, for example driver 168 for fuel injector 166 and driver 171 for fuel injector 170, may be used, as depicted.

In an alternate example, each of fuel injectors 166 and 170 may be configured as direct fuel injectors for injecting fuel directly into cylinder 14. In still another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector. As such, it should be appreciated that the fuel systems described herein should not be limited by the particular fuel injector configurations described herein by way of example.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

In one example, the amount of fuel to be delivered via port and direct injectors is empirically determined and stored in predetermined lookup tables or functions. For example, one table may correspond to determining port injection amounts and one table may correspond to determining direct injection amounts. The two tables may be indexed to engine operating conditions, such as engine speed and load, among other engine operating conditions. Furthermore, the tables may output an amount of fuel to inject via port fuel injection and/or direct injection to engine cylinders each cylinder cycle.

Accordingly, depending on engine operating conditions, fuel may be injected to the engine via port and direct injectors or solely via direct injectors or solely via port injectors. For example, controller 12 may determine to deliver fuel to the engine via port and direct injectors or solely via direct injectors, or solely via port injectors based on output from predetermined lookup tables as described above.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among fuel injectors 170 and 166, different effects may be achieved.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof etc. One example of fuels with different heats of vaporization could include gasoline as a first fuel type with a lower heat of vaporization and ethanol as a second fuel type with a greater heat of vaporization. In another example, the engine may use gasoline as a first fuel type and an alcohol containing fuel blend such as E85 (which is approximately 85% ethanol and 15% gasoline) or M85 (which is approximately 85% methanol and 15% gasoline) as a second fuel type. Other feasible substances include water, methanol, a mixture of alcohol and water, a mixture of water and methanol, a mixture of alcohols, etc.

In still another example, both fuels may be alcohol blends with varying alcohol composition wherein the first fuel type may be a gasoline alcohol blend with a lower concentration of alcohol, such as E10 (which is approximately 10% ethanol), while the second fuel type may be a gasoline alcohol blend with a greater concentration of alcohol, such as E85 (which is approximately 85% ethanol). Additionally, the first and second fuels may also differ in other fuel qualities such as a difference in temperature, viscosity, octane number, etc. Moreover, fuel characteristics of one or both fuel tanks may vary frequently, for example, due to day to day variations in tank refilling. As a further example, one or more of the first and second fuel types may comprise one or more gaseous fuels, including natural gas, compressed natural gas (CNG), liquefied natural gas (LNG), and propane.

Controller 12 is shown in FIG. 1 as a microcomputer, including microprocessor unit 106, input/output ports 108, an electronic storage medium for executable programs and calibration values shown as non-transitory read only memory chip 110 in this particular example for storing executable instructions, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold.

FIG. 2 schematically depicts an example fuel system 8 of FIG. 1. Fuel system 8 may be operated to deliver fuel from a fuel tank 202 to direct fuel injectors 252 and port injectors 242 of an engine, such as engine 10 of FIG. 1. Fuel system 8 may be operated by a controller to perform some or all of the operations described with reference to the process flow of FIG. 5.

Fuel system 8 can provide fuel to an engine from a fuel tank. By way of example, the fuel may include one or more hydrocarbon components, and may also include an alcohol component. Under some conditions, this alcohol component can provide knock suppression to the engine when delivered in a suitable amount, and may include any suitable alcohol such as ethanol, methanol, etc. Since alcohol can provide greater knock suppression than some hydrocarbon based fuels, such as gasoline and diesel, due to the increased latent heat of vaporization and charge cooling capacity of the alcohol, a fuel containing a higher concentration of an alcohol component can be selectively used to provide increased resistance to engine knock during select operating conditions.

As another example, the alcohol (e.g. methanol, ethanol) may have water added to it. As such, water reduces the alcohol fuel's flammability giving an increased flexibility in storing the fuel. Additionally, the water content's heat of vaporization enhances the ability of the alcohol fuel to act as a knock suppressant. Further still, the water content can reduce the fuel's overall cost. As a specific non-limiting example, fuel may include gasoline and ethanol, (e.g., E10, and/or E85). Fuel may be provided to fuel tank 202 via fuel filling passage 204.

A low pressure fuel pump (LPP) 208 in communication with fuel tank 202 may be operated to supply the fuel from the fuel tank 202 to a first group of port injectors 242, via a first fuel passage 230. LPP may also be referred to as a fuel lift pump, or a low pressure fuel lift pump. In one example, LPP 208 may be an electrically-powered lower pressure fuel pump disposed at least partially within fuel tank 202. Fuel lifted by LPP 208 may be supplied at a lower pressure into a first fuel rail 240 coupled to one or more fuel injectors of first group of port injectors 242 (herein also referred to as first injector group). An LPP check valve 209 may be positioned at an outlet of the LPP. LPP check valve 209 may direct fuel flow from LPP to fuel passages 230 and 290, and may block fuel flow from fuel passages 230 and 290 back to LPP 208. While first fuel rail 240 is shown dispensing fuel to four fuel injectors of first group of port injectors 242, it will be appreciated that first fuel rail 240 may dispense fuel to any suitable number of fuel injectors. As one example, first fuel rail 240 may dispense fuel to one fuel injector of first group of port injectors 242 for each cylinder of the engine. Note that in other examples, first fuel passage 230 may provide fuel to the fuel injectors of first group of port injectors 242 via two or more fuel rails. For example, where the engine cylinders are configured in a V-type configuration, two fuel rails may be used to distribute fuel from the first fuel passage to each of the fuel injectors of the first injector group.

Direct injection fuel pump 228 included in second fuel passage 232 and may be supplied fuel via LPP 208. In one example, direct injection fuel pump 228 may be a mechanically-powered positive-displacement pump. Direct injection fuel pump 228 may be in communication with a group of direct fuel injectors 252 via a second fuel rail 250. Direct injection fuel pump 228 may further be in fluid communication with first fuel passage 230 via fuel passage 290. Thus, lower pressure fuel lifted by LPP 208 may be further pressurized by direct injection fuel pump 228 so as to supply higher pressure fuel for direct injection to second fuel rail 250 coupled to one or more direct fuel injectors 252 (herein also referred to as second injector group). In some examples, a fuel filter (not shown) may be disposed upstream of direct injection fuel pump 228 to remove particulates from the fuel. Further, in some examples a fuel pressure accumulator (not shown) may be coupled downstream of the fuel filter, between the low pressure pump and the high pressure pump.

The various components of fuel system 8 communicate with an engine control system, such as controller 12. For example, controller 12 may receive an indication of operating conditions from various sensors associated with fuel system 8 in addition to the sensors previously described with reference to FIG. 1. The various inputs may include, for example, an indication of an amount of fuel stored in each of fuel tanks 202 and 212 via fuel level sensor 206. Controller 12 may also receive an indication of fuel composition from one or more fuel composition sensors, in addition to, or as an alternative to, an indication of a fuel composition that is inferred from an exhaust gas sensor (such as sensor 126 of FIG. 1). For example, an indication of fuel composition of fuel stored in fuel tanks 202 and 212 may be provided by fuel composition sensor 210. Fuel composition sensor 210 may further comprise a fuel temperature sensor. Additionally or alternatively, one or more fuel composition sensors may be provided at any suitable location along the fuel passages between the fuel storage tanks and their respective fuel injector groups. For example, fuel composition sensor 238 may be provided at first fuel rail 240 or along first fuel passage 230, and/or fuel composition sensor 248 may be provided at second fuel rail 250 or along second fuel passage 232. As a non-limiting example, the fuel composition sensors can provide controller 12 with an indication of a concentration of a knock suppressing component contained in the fuel or an indication of an octane rating of the fuel. For example, one or more of the fuel composition sensors may provide an indication of an alcohol content of the fuel.

Note that the relative location of the fuel composition sensors within the fuel delivery system can provide different advantages. For example, fuel composition sensors 238 and 248, arranged at the fuel rails or along the fuel passages coupling the fuel injectors with fuel tank 202, can provide an indication of a fuel composition before being delivered to the engine. In contrast, sensor 210 may provide an indication of the fuel composition at the fuel tank 202.

Fuel system 8 may also comprise pressure sensor 234 in fuel passage 290, and pressure sensor 236 in second fuel passage 232. Pressure sensor 234 may be used to determine a fuel line pressure of fuel passage 290 which may correspond to a low pressure pump delivery pressure. Pressure sensor 236 may be positioned downstream of DI fuel pump 228 in first fuel passage 232 and may be used to measure a DI pump delivery pressure. As described above, additional pressure sensors may be positioned at the first fuel rail 240 and the second fuel rail 250 to measure the pressures therein.

Controller 12 can also control the operation of each of fuel pumps 208 and 228 to adjust an amount, pressure, flow rate, etc., of a fuel delivered to the engine. As one example, controller 12 can vary a pressure setting, a pump stroke amount, a pump duty cycle command and/or fuel flow rate of the fuel pumps to deliver fuel to different locations of the fuel system. As one example, a DI fuel pump duty cycle may refer to a fractional amount of a full DI fuel pump volume to be pumped. Thus, a 10% DI fuel pump duty cycle may represent energizing a solenoid activated check valve (also referred to as a spill valve) such that 10% of the full DI fuel pump volume may be pumped. A driver (not shown) electronically coupled to controller 12 may be used to send a control signal to the LPP 208, as required, to adjust the output (e.g. speed, delivery pressure) of the LPP 208. The amount of fuel that is delivered to the group of direct injectors via the direct injection pump may be adjusted by adjusting and coordinating the output of the LPP 208 and the direct injection fuel pump 228. For example, controller 12 may control the LPP 208 through a feedback control scheme by measuring the low pressure pump delivery pressure in fuel passage 290 (e.g., with pressure sensor 234) and controlling the output of the LPP 208 in accordance with achieving a desired (e.g. set point) low pressure pump delivery pressure.

LPP 208 may be used for supplying fuel to both the first fuel rail 240 during port fuel injection and the DI fuel pump 228 during direct injection of fuel. During both port fuel injection and direct injection of fuel, LPP 208 may be controlled by controller 12 supply fuel to the first fuel rail 240 and/or the DI fuel pump 228 at a fuel pressure greater than a fuel vapor pressure. In one example LPP 208 may supply fuel at a fuel pressure greater than a fuel vapor pressure corresponding to the highest temperature in the fuel system 8. Furthermore, during port fuel injection, controller 12 may control LPP 208 in a continuous mode to continuously supply fuel at a constant fuel pressure greater than a threshold fuel pressure, $P_{fuel,TH}$. In one example, $P_{fuel,TH}$ may correspond to an average or typical fuel vapor pressure during normal engine operation. Accordingly, when PFI injection is ON, controller 12 may maintain operation of LPP 208 ON to supply a constant fuel pressure to first fuel rail 240 and to maintain a relatively constant port fuel injection pressure.

On the other hand, during direct injection of fuel when port fuel injection is off, controller 12 may control LPP 208 to supply fuel to the DI fuel pump 228 at a fuel pressure greater than a current fuel vapor pressure. Furthermore, because the fuel vapor pressure may vary with fuel system temperature and fuel composition, and the like, the current fuel vapor pressure may not remain constant during engine operation. As such, during direct injection of fuel when port fuel injection is off, the fuel pressure supplied by LPP 208 to DI fuel pump 228 may vary, as long as it remains greater than the current fuel vapor pressure. Furthermore, during direct injection of fuel when port fuel injection is off, and when the pressure in fuel passage 290 remains greater than the current fuel vapor pressure, LPP 208 may be temporarily switched OFF without affecting DI fuel injector pressure control. For example, LPP 208 may be operated in a pulsed mode, where the LPP is alternately switched ON and OFF to maintain a fuel pressure greater than a current fuel vapor pressure.

Operation of LPP 208 in a pulsed mode may be advantageous because certain fuel system diagnostic methods may be performed when the LPP 208 is OFF. For example, during pulse mode operation of LPP 208 when LPP 208 is switched OFF, diagnosing a faulty LPP check valve 209 may be more easily performed as compared to when LPP 208 is ON. For example, a faulty LPP check valve 209 may be detected by a sensing a rapid decrease in a pressure in fuel passage 290 (measured by pressure sensor 234) when LPP 208 is switched OFF. Furthermore, upon detection of a faulty LPP check valve 209, controller may operate LPP 208 in continuous mode to ensure than enough fuel is supplied to the port fuel injection system and the direct injection system, even when the LPP check valve 209 has failed.

As another example, when LPP 208 is switched OFF during pulse mode operation of the LPP 208, a fuel vapor pressure calibration method may be performed to determine a current fuel vapor pressure. In particular, controller 12 may monitor the pressure in fuel passage 290 while the LPP 208 is OFF. After a threshold fuel volume is delivered from fuel passage 290 to the second fuel rail 250 via the DI fuel pump 228, fuel passage 290 may not be filled with liquid fuel and may comprise both liquid fuel and fuel vapor. Accordingly, a pressure in fuel passage 290 may be equivalent to a current fuel vapor pressure. Thus, the current fuel vapor pressure may be determined by pressure sensor 234 after a threshold fuel volume has been delivered from fuel passage 290 via DI fuel pump 228 when LLP 208 is OFF. The threshold fuel volume may be predetermined according to parameters of fuel system 8, such as the volume of the fuel passages 290 and 230. In one example, the threshold fuel volume may be greater than 6 mL. Furthermore, during pulse mode when LPP 208 is ON, controller 12 may operate LPP 208 to deliver fuel at a desired fuel pressure, the desired fuel pressure being greater than the current fuel vapor pressure by a threshold pressure differential. In one example, the threshold pressure differential may comprise 0.3 bar. By determining a current fuel vapor pressure and by operating LPP 208 to deliver fuel at the desired fuel pressure (greater than the current fuel vapor pressure by a threshold pressure differential), cavitation at the DI fuel pump 228 may be reduced. The threshold pressure differential may be predetermined according to engine operation characteristics. For example, the threshold pressure differential may be set to a pressure differential that is large enough so that if there are small fluctuations in the operation of the LPP 208, or if pressure measurements of the pressure sensor in the fuel passage are noisy, the LPP 208 delivery pressure can still be substantially maintained above the current fuel vapor pressure.

As another example, LPP 208 and the DI fuel pump 228 may be operated to maintain a desired fuel rail pressure. A fuel rail pressure sensor (not shown) coupled to the second fuel rail may be configured to provide an estimate of the fuel pressure available at the group of direct injectors. Then, based on a difference between the estimated rail pressure and a desired rail pressure, the pump outputs may be adjusted. In one example, where the DI fuel pump is a volumetric displacement fuel pump, the controller may adjust a flow control valve (e.g., solenoid activated check valve) of the DI fuel pump to vary the effective pump volume (e.g., pump duty cycle) of each pump stroke.

As another example, controller 12 may adjust the output of direct injection fuel pump 228 by adjusting a flow control valve (e.g., solenoid activated check valve) of direct injection fuel pump 228. Direct injection pump may stop providing fuel to fuel rail 250 during selected conditions such as during vehicle deceleration or while the vehicle is traveling downhill. Further, during vehicle deceleration or while the vehicle is traveling downhill, one or more direct fuel injectors 252 may be deactivated. As such, while the direct injection fuel pump is operating, compression of fuel in the compression chamber ensures sufficient pump lubrication and cooling because the higher compression chamber pressure drives fuel into and lubricates the piston-bore interface. However, during conditions when direct injection fuel pump operation is not requested, such as when no direct injection of fuel is requested, the direct injection fuel pump may not be sufficiently lubricated if fuel flow through the pump is discontinued.

Fuel vapor pressure may vary depending on temperature and fuel composition. Fuel vapor temperatures increase with fuel temperature, and thus temperature fluctuations in the fuel system may cause the fuel vapor pressure to fluctuate. Temperature fluctuations may be caused by engine operating conditions such as engine running time and load, as well as external conditions such as ambient temperature, road surface temperature, humidity, and the like. Fuel vapor pressure may also vary with fuel composition. For example winter-grade (e.g., cold weather) fuel compositions may have a higher volatility than summer grade (e.g., warm weather) fuel compositions in order to reduce vehicle emissions, while maintaining vehicle drivability and operability. As an example, cold weather starting will be more difficult when liquid gasoline in the cylinder combustion chambers has not vaporized. Further still fuel composition may also vary with different fuel grades (e.g., high octane vs. regular) and fuel additives, such as ethanol or butanol.

Fuel volatility (e.g., fuel vapor pressure) may have a direct consequence on the efficiency of an internal combustion engine. For example, combustion air-fuel ratio, which is a factor in determining fuel injection to an engine cylinder, is affected by fuel volatility. On-board diagnostic monitors of an engine controller may also utilize fuel volatility estimates, for example, in the monitoring and detection of fuel system vapor leaks. Furthermore, if the LPP does not deliver fuel at a pressure greater than the fuel vapor pressure, fuel from the fuel tank cannot be delivered to the fuel injectors, and may cause cavitation of the direct injection fuel pump.

Turning now to FIG. 3A, it illustrates an example timeline 300 of a pressure 330 in fuel passage 290 downstream from LPP 208 and upstream from DI fuel pump 228, and a volume of fuel 320 in fuel passage 290, during deliver of fuel from fuel passage 290 by a DI fuel pump for DI fuel injection when LPP 208 is switched OFF. Timeline 300 also depicts a current fuel vapor pressure 340. As fuel is delivered from fuel passage 290 by the DI fuel pump, the volume of fuel 320 in the fuel line, and the pressure 330 in the fuel passage 290 decrease correspondingly. At time t1, the pressure 330 decreases to the fuel vapor pressure 340. For example, at time t1, the fuel passage 290 may comprise liquid fuel and fuel vapor. After time t1, although fuel injection continues (e.g., the volume of fuel 320 continues dropping after t1) while the LPP 208 is switched off, the pressure 330 in the fuel line is maintained at the fuel vapor pressure 340, due to the presence of fuel vapor exerting a vapor pressure in the fuel passage 290. In one example, pressure drop 332 may represent a decrease in fuel pressure by 7 bar, and may correspond to a fuel volume 324 of 5 mL being delivered from fuel passage 290, while the LPP is switched off. A threshold fuel volume 322 may not be delivered from fuel passage 290 until after time t2, when the pressure 330 has decreased to the fuel vapor pressure 340.

In this way, a fuel vapor pressure may be estimated by monitoring a pressure in fuel passage 290 while delivering fuel from the fuel passage 290 via a DI fuel pump 228 and while the LPP is switched off. In particular, the fuel vapor pressure may be estimated as the fuel passage pressure when at least the threshold fuel volume 322 has been delivered from the fuel passage 290 via a DI fuel pump 228 and while the LPP is switched off. Alternately, a current fuel vapor pressure may be determined by monitoring a fuel passage pressure compliance (e.g., rate of change in fuel passage pressure relative to the volume of fuel delivered from fuel passage while LPP 208 is OFF). For example, if the fuel passage pressure compliance decreases below a threshold compliance while injecting fuel via a DI fuel pump and while the LPP is switched off, the measure fuel passage pressure may be equivalent to the current fuel vapor pressure.

Furthermore, by controlling the LPP 208 to supply a fuel pressure greater than or equal to the current fuel vapor pressure, cavitation in the fuel system may be reduced. As described above, controller 12 may control LPP 208 to supply a fuel pressure greater than the determined current fuel vapor pressure by a threshold pressure differential.

The fuel vapor pressure is the pressure exerted by fuel vapor in thermodynamic equilibrium with liquid fuel. Fuel vapor pressure depends on temperature and fuel composition. For example, fuel vapor pressure increases as the fuel temperature increases (e.g., when the engine warms up, or when ambient temperature increases). Furthermore, summer-grade fuels may have lower vapor pressures than winter-grade fuels to reduce vapor lock and reduce engine emissions when ambient temperatures are high, and to increase vehicle drivability. Accordingly, the fuel vapor pressure may be estimated if a condition for calibrating a fuel vapor pressure is satisfied. As an example, a condition for a calibration step being satisfied may include one or more of the direct fuel injection just being switched ON, a fuel temperature difference relative to a previously measured fuel temperature being greater than a threshold temperature difference, the direct fuel injection status being ON for greater than a threshold duration, a volume of fuel injected via direct fuel injection being greater than a threshold volume, and a fuel refill having been performed.

Air solubilized in the fuel may shift the estimated fuel vapor pressure higher relative to the actual vapor pressure of the fuel (in the absence of solubilized air). However, by controlling the LPP 208 to supply a fuel pressure greater than or equal to the current fuel vapor pressure, cavitation in the fuel system may be reduced.

Turning now to FIG. 3B, it illustrates a timeline of an example fuel vapor pressure calibration method for estimating a fuel vapor pressure in a fuel passage downstream of a LPP 208. FIG. 3B shows timelines for LPP status 370, fuel passage pressure 380 downstream of the LPP (and upstream of a DI fuel pump), a current fuel vapor pressure 340, a DI injection volume 390, and fuel passage pressure compliance 396. The fuel passage pressure compliance 396 represents the rate of decrease of the fuel passage pressure relative to a DI injection volume (e.g., volume of fuel delivered from the fuel passage 290 for direct injection).

At time t1, during direct injection of fuel, the LPP status 370 is switched OFF. As fuel is direct injected to the engine, fuel is supplied to the direct injection pump compression chamber from the fuel passage to replenish the DI fuel rail. When the LPP status is OFF, no fuel is supplied to the fuel passage, and a fuel passage pressure 380 begins to decrease with each pulse injection of fuel by the DI injection pump.

At time t2, the fuel passage pressure decreases to a pressure equivalent to the actual fuel vapor pressure 340. When the fuel passage contains liquid fuel the fuel passage pressure cannot drop below the pressure exerted by the fuel vapor (e.g., the fuel vapor pressure). Thus, although direct injection of fuel continues after t2 as shown by the DI injection volume 390, the fuel passage pressure maintains a value of the fuel vapor pressure, and the apparent fuel passage pressure compliance drops to zero. In this way, FIG. 3B illustrates that an estimate of the fuel vapor pressure may be obtained by shutting off the LPP and measuring the apparent fuel passage pressure compliance 396. In particular the fuel passage pressure 380 may be equivalent to the fuel vapor pressure when the fuel passage pressure compliance drops below a threshold compliance.

In the example of FIG. 3B, the threshold compliance may be zero, however a non-zero threshold compliance may be used to account for uncertainties in pressure sensor measurements and other pressure disturbances such as fluctuations in fuel passage pressure due to DI injection. For example, a threshold compliance may correspond to a typical fuel passage pressure compliance of approximately 1.0 bar per cubic centimeter (e.g., for every cubic centimeter of fuel injected or displaced from the fuel passage, the fuel passage pressure decreases by 1.0 bar). As another example, a typical value for the fuel passage pressure compliance may be predetermined a priori to be approximately 0.6 bars per cubic centimeter (cc) of fuel injected while the LPP status is OFF, however the fuel passage pressure compliance may vary depending on a fuel passage volume, temperature, and fuel vapor composition. Accordingly, when a fuel passage pressure compliance is less than a threshold compliance, then the fuel vapor pressure may be maintaining the fuel passage pressure. Thus, when a fuel passage pressure compliance is less than a threshold compliance, an estimate of the fuel vapor pressure may be obtained from the fuel passage pressure. In one example, a fuel model may be used to predetermine a rate of pressure decrease in a fuel passage with respect to fuel volume injected, to estimate a threshold compliance.

Accordingly, at t3, after a fuel passage pressure compliance drops below a threshold compliance, controller 12 may switch on the LPP status, and set a desired LPP pressure to the estimated fuel vapor pressure plus a threshold differential pressure, as described above. In this manner, cavitation in the fuel passage and the DI injection pump can be reduced, and vehicle drivability and operability can be increased.

Furthermore, a fuel vapor pressure may be determined from the fuel passage pressure after pumping a threshold volume of fuel from the fuel passage via the DI fuel pump while the LPP is switched OFF. The threshold volume of fuel may represent the volume of fuel that may be pumped from the fuel passage from a previously filled state (e.g., when the fuel passage was filled with liquid fuel) after which an apparent fuel passage pressure compliance is zero. For example, the threshold volume may be predetermined to be 10 cc or 6 cc.

Turning to FIG. 4, it shows an example of direct injection fuel pump 228 shown in the fuel system 8 of FIG. 2. Inlet 403 of direct injection fuel pump compression chamber 408 may be supplied fuel via a LPP 208 as shown in FIG. 2. The fuel may be pressurized upon its passage through direct injection fuel pump 228 and supplied to a fuel rail through pump outlet 404. In the depicted example, direct injection fuel pump 228 may be a mechanically-driven displacement pump that includes a pump piston 406 and piston rod 420, a pump compression chamber 408 (herein also referred to as compression chamber), and a step-room 418. Piston 406 includes a piston bottom 405 and a piston top 407. The step-room and compression chamber may include cavities positioned on opposing sides of the pump piston. In one example, engine controller 12 may be configured to drive the piston 406 in direct injection fuel pump 228 by driving cam 410. Cam 410 may include four lobes and may be driven by the engine crankshaft 140, wherein cam 410 completes one rotation for every two engine crankshaft rotations.

Piston 406 may move in a reciprocating motion along the cylinder walls 450 as actuated by cam 410. Direct fuel injection fuel pump 228 is in a compression stroke when piston 406 is traveling in a direction that reduces the volume of compression chamber 408. Direct fuel injection fuel pump 228 is in a suction stroke when piston 406 is traveling in a direction that increases the volume of compression chamber 408.

A solenoid activated inlet check valve 412 may be coupled to pump inlet 403. Controller 12 may be configured to regulate fuel flow through inlet check valve 412 by energizing or de-energizing the solenoid valve (based on the solenoid valve configuration) in synchronization with the driving cam 410. Accordingly, solenoid activated inlet check valve 412 may be operated in two modes. In a first mode, solenoid activated check valve 412 is positioned within inlet 403 to limit (e g inhibit) the amount of fuel traveling in an upstream direction through the solenoid activated check valve 412. In the second mode, solenoid activated check valve 412 may be de-energized to a pass through mode, whereby fuel can travel in an upstream and downstream direction to and from compression chamber 408 through inlet check valve 412.

Operation of the solenoid activated check valve (e.g., when energized) may result in increased NVH because cycling the solenoid activated check valve may generate ticks as the valve is seated or is fully opened against the fully open valve limit. Furthermore, when the solenoid activated check valve is de-energized to pass through mode, NVH arising from valve ticks may be substantially reduced. As an example, the solenoid activated check valve may be de-energized when the engine is idling since during engine idling conditions, fuel is injected via port fuel injection.

As such, controller 12 may regulate the mass of fuel compressed into the direct injection fuel pump via solenoid activated check valve 412. In one example, controller 12 may adjust a closing timing of the solenoid activated check valve to regulate the mass of fuel compressed. For example, a late inlet check valve closing relative to piston compression (e.g. volume of compression chamber is decreasing) may reduce the amount of fuel mass delivered from the compression chamber 408 to the pump outlet 404 since more of the fuel displaced from the compression chamber can flow through the inlet check valve before it closes. In contrast, an early inlet check valve closing relative to piston compression may increase the amount of fuel mass delivered from the compression chamber 408 to the pump outlet 404 since less of the fuel displaced from the compression chamber can flow through the inlet check valve before it closes. Thus, the solenoid activated check valve opening and closing timings may be coordinated with respect to stroke timings of the direct injection fuel pump. By continuously throttling the flow into the direct injection fuel pump from the LPP, fuel may be ingested into the direct injection fuel pump without requiring metering of the fuel mass. Conversely, if fuel flow from the LPP is stopped or if the fuel flow from the LPP is less than the fuel flow out of the direct injection pump towards the DI fuel rail for an extended period of time, fuel flow to the direct injection pump may be insufficient, leading to cavitation of the direct injection fuel pump 228.

Fuel pumped from LPP 208 may be delivered via pump inlet 499 to solenoid activated check valve 412 along passage 435. When solenoid operated check valve 412 is deactivated (e.g., not electrically energized), solenoid operated check valve operates in a pass through mode.

Control of solenoid activated check valve 412 may also contribute to regulating the pressure in compression chamber 408. The pressure at piston top 407 and in step-room 418 may be equivalent to the pressure of the outlet pressure of the low pressure pump while the pressure at piston bottom 405 is at a compression chamber pressure. Accordingly, during piston compression, the pressure at the piston bottom 405 may be greater than the pressure at the piston top 407, thereby forming a pressure differential across the piston 406 between piston bottom 405 and piston top 407. The pressure differential across the piston may cause fuel to seep from piston bottom 405 to piston top 407 through the mechanical clearances between the piston 406 and the pump cylinder wall 450, thereby lubricating direct injection fuel pump 228. As such, maintaining a pressure differential across the piston 406 wherein the pressure at the piston bottom 405 is greater than the piston top 407 may maintain lubrication of the direction injection fuel pump.

A forward flow outlet check valve 416 may be coupled downstream of a pump outlet 404 of the compression chamber 408. Outlet check valve 416 opens to allow fuel to flow from the compression chamber to the pump outlet 404 into a fuel rail when a pressure at the outlet of direct injection fuel pump 228 (e.g., a compression chamber outlet pressure) is higher than the downstream fuel rail pressure. Thus, during conditions when direct injection fuel pump operation is not requested, controller 12 may control the DI fuel pump command such that a pressure in the compression chamber is less than a fuel rail pressure to allow for lubrication of the piston, even when fuel is not direct injected to the direct injection fuel rail.

Specifically, the pressure in compression chamber 408 may be regulated during the compression stroke of direct injection fuel pump 228. Thus, during at least the compression stroke of direct injection fuel pump 228 operation, lubrication is provided to the piston 406. During a suction stroke of the direct fuel injection pump, fuel pressure in the compression chamber may be reduced. However, as long as there is a pressure differential (e.g., pressure at piston bottom 405 is greater than pressure at piston top 407) some quantity of fuel may flow from the compression chamber to the step room, thereby lubricating the DI fuel pump. At low piston speeds, lubrication of the DI fuel pump may be provided by lower pressure differentials, whereas at higher piston speeds, lubrication of the DI fuel pump may be provided by higher pressure differentials. In particular, at higher piston speeds, a larger pressure differential may allow for hydrodynamic lubrication between the piston and the piston bore.

Accordingly, the solenoid activated check valve duty cycle may control how much of the DI fuel pump's actual displacement is being engaged to pump fuel to the DI fuel rail. In one example, the duty cycle is increased to increase flow through the direct injection fuel pump and to the direct injection fuel rail. In other examples, the DI fuel pump command signal may be adjusted in response to the amount of fuel to be delivered to the engine. Modulation of the fuel pump command signal may include adjusting one or more of a current level, current ramp rate, a pulse-width, a duty cycle, or another modulation parameter of the fuel pump solenoid activated check valve. As one example, a DI fuel pump duty cycle may refer to a fractional amount of a full DI fuel pump volume to be pumped. Thus, a 10% DI fuel pump duty cycle may represent energizing a solenoid activated check valve (also referred to as a spill valve) such that 10% of the full DI fuel pump volume may be pumped.

The LPP outlet pressure may also be adjusted in response to the amount of fuel to be delivered to the engine. For example, LPP output may be increased as the amount of fuel injected to the engine via the DI fuel rail and/or the port injection fuel rail is increased. Fuel is thus supplied to the engine via the port and direct fuel injectors.

As described herein, an example of an engine system may be provided, comprising: a PFDI engine; a DI fuel pump; a fuel lift pump; and a controller, comprising executable instructions to: during a first condition, comprising direct-injecting fuel to the PFDI engine, estimating a fuel vapor pressure, and setting a pressure of the fuel lift pump greater than the fuel vapor pressure by a threshold pressure difference; and during a second condition, comprising port-fuel-injecting fuel to the PFDI engine, setting a DI fuel pump duty cycle to a threshold duty cycle without supplying fuel to a DI fuel rail. The engine system may further comprise, during the first condition, when a desired lift pump pressure is greater than the fuel vapor pressure, controlling the lift pump pressure via feedback control, and when the desired lift pump pressure is less than the fuel vapor pressure, controlling the fuel lift pump to supply the pressure equivalent to the fuel vapor pressure plus the threshold pressure difference.

Turning now to FIG. 5, it illustrates a flow chart of a method 500 of operating a port fuel direct injection (PFDI) engine system to increase direct injection pump durability without increasing NVH, and to increase robustness of fuel delivery to the direct injection fuel pump while reducing power consumption and without reducing low pressure pump durability. Method 500 may be executed by a controller 12.

In one example, the amount of fuel to be delivered via port and direct injectors may be empirically determined and stored into predetermined lookup tables or functions, one table for port injection amount and one table for direct injection amount. The two lookup tables may be indexed via engine speed and load and may output an amount of fuel to inject to engine cylinders each cylinder cycle.

Method 500 begins at 506 where it estimates engine operating conditions such as engine load, vehicle speed, direct injection status, fuel passage pressure, low pressure pump status, low pressure pump pressure, and the like. Method 500 then continues at 510 where it determines if direct fuel injection is ON and port fuel injection is OFF. As an example, under lower engine load conditions, including engine idle conditions, fuel may be injected to the engine only via port fuel injection. In contrast, under higher engine load conditions, fuel may be injected to the engine only via direct injection. Accordingly, engine performance may be increased (e.g., increased available torque and fuel economy) at high engine loads, while vehicle emissions, NVH, and wear of the direct injection system components may be reduced at lower engine loads.

If at 510 the direct fuel injection is ON and port fuel injection is OFF, method 500 continues at 520 where it determines if a condition for a calibration step is satisfied. A condition for a calibration step may be satisfied when engine operating conditions indicate that a fuel vapor pressure may have substantially changed from a previously estimated fuel vapor pressure. A condition for a calibration step being satisfied may include one or more of the direct fuel injection just being switched ON, a fuel temperature difference relative to a previously measured fuel temperature being greater than a threshold temperature difference, the direct fuel injection status being ON for greater than a threshold duration, a volume of fuel injected via direct fuel injection being greater than a threshold volume, and a fuel refill having been performed. A condition for a calibration step being satisfied may further include if a fuel change due to a recent tank refill is expected and/or if the apparent volumetric efficiency of the DI fuel pump decreases greater than a threshold decrease. The condition for a calibration step may be satisfied by other engine events that may substantially change a fuel temperature, a fuel composition, and/or the vapor pressure of the fuel supplied to the DI fuel pump.

If the direct fuel injection status has recently been switched ON, a condition for a calibration step may be satisfied because the engine operating conditions (e.g. engine temperature, fuel refill, and the like) may have changed since the last estimate of fuel vapor pressure was made. If a change in measured fuel temperature (e.g., via sensor 210) relative to a previously measured fuel temperature is greater than a threshold temperature difference, a condition for a calibration step may be satisfied because the fuel vapor pressure may be substantially different than a previously estimated fuel vapor pressure. If the direct fuel injection status is ON for greater than a threshold duration or if a volume of fuel injected via direct fuel injection is greater than a threshold volume, a condition for a calibration step may be satisfied because the fuel composition and/or fuel temperature may have changed and the fuel vapor pressure may be substantially different than a previously estimated fuel vapor pressure. If a fuel refill has been performed, a condition for a calibration step may be satisfied because the fuel composition may have changed and the fuel vapor pressure may be substantially different than a previously estimated fuel vapor pressure.

If a condition for a calibration step is satisfied, indicating that the fuel vapor pressure may have substantially changed, method 500 performs a fuel vapor pressure calibration step 530 in order to estimate a current fuel vapor pressure. By updating the estimated fuel vapor pressure when the actual fuel vapor pressure may have substantially changed, method 500 may reduce cavitation in a fuel passage and/or at the DI fuel pump. At 532, method 500 reduces a low pressure pump power. As an example, the low pressure pump power may be reduced below a threshold low pressure pump power, or the low pressure pump status may be switched OFF, in order to accurately measure a fuel passage pressure compliance. When the LPP is below the threshold low pressure pump power, operation of the low pressure pump does not substantially change either the fuel passage pressure or the volume of fuel in the fuel passage. In other words, operating the low pressure pump below the low pressure pump threshold power does not influence the calculation of a fuel passage pressure compliance. Furthermore, because the LPP does not directly supply fuel injection pressure, the LPP power may be reduced (or switched OFF) at 532 for a brief shut off time to allow estimation of the fuel vapor pressure.

In one example, at 534, a fuel passage pressure compliance of fuel passage 290 may be determined by measuring the volume of fuel direct injected via DI fuel pump 228 and by measuring the pressure in fuel passage 298 via pressure sensor 234, while LPP 208 status is OFF. While the LPP status is OFF, a pressure change in fuel passage 290 may be substantially due to a change in volume of fuel in fuel passage 290. In particular, fuel displaced out from fuel passage 290 during DI fuel injection via DI fuel pump 228 may cause pressure in fuel passage 290 to decrease. Accordingly a fuel passage pressure compliance (e.g. the change in pressure with respect to the change in volume of fuel injected via DI fuel pump while LPP status is OFF) may be calculated.

At 536, method 500 determines if the calculated fuel passage pressure compliance is less than a threshold compliance, $\text{Compliance}_{TH}$. As one example, the $\text{Compliance}_{TH}$ may be essentially zero, or a substantially lower pressure compliance value in comparison to a predetermined pressure compliance value during engine operation when the low pressure pump power is greater than a threshold low pressure pump power. If the calculated fuel passage pressure compliance is greater than $\text{Compliance}_{TH}$, method 500 returns to 534 and continues monitoring the fuel passage pressure compliance by measuring the volume of direct injected fuel and the fuel passage pressure while the low pressure pump status is OFF (or below a threshold low pressure pump power).

If at 536 the fuel passage pressure compliance is less than $\text{Compliance}_{TH}$, the pressure in fuel passage may have reached the fuel vapor pressure, and method 500 continues at 538 where the estimated fuel vapor pressure, $P_{vap,fuel}$ is set to the current fuel passage pressure. As described above, when there is liquid fuel present in a fuel passage, the fuel passage pressure will not decrease below the fuel vapor pressure. Upon completion of 538, the fuel vapor pressure calibration step 530 is completed. In this manner, an up to date measure of the fuel vapor pressure in the fuel passage upstream of the DI fuel pump is maintained, even after one or more of a fuel refill is performed, direct injection of fuel has just been switched on, direct injection of fuel has been ON for greater than a threshold time, the volume of fuel direct injected to the engine is greater than a threshold volume, or other engine conditions that may substantially change a fuel temperature and/or composition.

As another example, the fuel vapor pressure may be estimated by determining a fuel passage pressure compliance in fuel passage 230 or another fuel passage by measuring a fuel passage pressure thereat, and by measuring a volume of fuel displaced from the fuel passage by direct injection and/or port fuel injection under conditions when fuel is not being supplied to the fuel passage. When the fuel passage pressure compliance decreases to $\text{Compliance}_{TH}$, the fuel vapor pressure may be estimated as the fuel passage pressure. Alternately, as previously described, a current fuel vapor pressure may be determined by measuring the fuel passage pressure after a threshold fuel volume is delivered from the fuel passage by the DI fuel pump when the LPP is OFF.

As described above, an alternative method for determining the current fuel vapor pressure at 534 may comprise: delivering a threshold fuel volume via DI fuel pump from the fuel passage 290 for direct fuel injection after the LPP 208 is switched OFF; and setting $P_{vap,fuel}$ to the current fuel passage pressure at 538. In other words, after delivering the threshold fuel volume via DI fuel pump from the fuel passage 290 for direct fuel injection after the LPP 208 is switched OFF, the fuel pressure compliance is less than the threshold compliance. This alternative method for determining the current fuel vapor pressure may be advantageous by not calculating the fuel passage pressure compliance at 536; however, the threshold fuel volume may be predetermined according to the characteristics (e.g., volume, fuel composition) of the fuel system 8. After completing the $P_{vap,fuel}$ calibration, method 500 ends.

Returning to 510, if a direct fuel injection status is OFF, or returning to 520, if conditions for a calibration step are not satisfied, method 500 continues at DI fuel pump lubrication 540, where DI fuel pump lubrication is maintained to reduce NVH and DI pump degradation, depending on engine load and fuel injection conditions, and even when fuel is not being injected to the engine via direct injection.

At 550, method 500 determines if the engine is idling and fuel is being injected to the engine via port fuel injection. If the engine is idling and fuel injection is via port fuel injection, method 500 continues at 556 where the DI fuel pump command signal is set to 0%, thereby de-energizing the solenoid activated check valve 412 to a pass through mode. Setting a DI fuel pump command signal to 0% and de-energizing the solenoid activated check valve 412 to a pass through mode reduces NVH arising since the solenoid activated check valve remains open and NVH resulting from the solenoid energizing may be substantially reduced. Furthermore, owing to forward flow outlet check valve 416, after the solenoid activated check valve 412 is de-energized, the compression chamber pressure may be at or above a fuel rail pressure. Accordingly a pressure differential across piston 406 may exist that is equivalent to a difference between a fuel rail pressure and a LPP pressure. Thus, even though solenoid activated check valve 412 is de-energized, a compression chamber pressure at the piston bottom 405 may be higher relative to a pressure at piston top 407, and lubrication of the piston can be maintained. In this way, during engine idling, NVH may be reduced while maintaining lubrication of the DI fuel pump.

If at 550 the engine is not idling and fuel is not being injected via port fuel injection, then controller 12 may proceed to maintain DI fuel pump lubrication by enforcing a DI fuel pump command greater than a threshold pump command, $PC_{TH}$. Method 500 continues from 560 where it sets $PC_{TH}$ based on a target DI fuel rail pressure. The target DI fuel rail pressure may depend on engine operating conditions such as the injection mode (e.g., PFI, DI, or PFI and DI), engine load, torque, fuel/air ratio, and the like. For example, if the engine is operating under port fuel injection only (e.g., DI is OFF) and/or at lower loads, the target DI fuel rail pressure may be lower; whereas if the engine is operating under DI fuel injection only (e.g., PFI is OFF) and/or at higher loads, the target DI fuel rail pressure may be higher. In one example, $PC_{TH}$ may be varied from a lower threshold pump command to an upper threshold pump command. In particular, a lower threshold pump command may comprise 5%, while an upper threshold pump command may comprise 10% pump command based on the target DI fuel rail pressure. Under conditions where the target DI fuel rail pressure is higher, $PC_{TH}$ may be set higher (e.g., closer to the upper threshold pump command). Furthermore, under conditions where the target DI fuel rail pressure is lower, $PC_{TH}$ may be set lower (e.g., closer to the lower threshold pump command). In this way, when the engine is not PFI idling, the DI fuel pump command may be enforced to be greater than $PC_{TH}$, thereby maintaining DI fuel pump lubrication to reduce NVH and DI fuel pump degradation.

Setting the DI fuel pump command signal to a threshold pump command, $PC_{TH}$, may include energizing solenoid activated check valve to adjust one or more of a current level, current ramp rate, a pulse-width, a duty cycle, or another modulation parameter of the fuel pump solenoid activated check valve to a threshold value. Specifically, solenoid activated check valve may be energized such that a pressure in compression chamber 408 is maintained lower than a direct injection fuel rail pressure. In this way controller 12 may maintain a pressure differential across piston 406 to sustain lubrication of the DI fuel pump, thereby mitigating NVH and DI fuel pump degradation during engine idle conditions, even when fuel may not be direct injected into the engine.

If the pump command signal is greater than the upper threshold pump command, then the duty cycle of solenoid activated check valve and timing of opening and closing thereof relative to the DI fuel pump piston motion may result in a piston compression chamber pressure greater than a DI fuel rail pressure. Accordingly, if the $PC_{TH}$ is greater than the upper threshold pump command, the DI fuel pump may deliver fuel to the DI fuel rail. Furthermore, if the $PC_{TH}$ is greater than the upper threshold pump command, NVH resulting from operation of the solenoid activated check valve may increase above a threshold operator-tolerable NVH.

When $PC_{TH}$ comprises a pump command signal between the lower threshold pump command and the upper threshold pump command, the DI fuel pump compression chamber pressure may be maintained less than a DI fuel rail pressure so that a forward flow outlet check valve 416 remains closed and fuel may not be delivered to the DI fuel rail. Furthermore, when $PC_{TH}$ comprises a pump command signal between the lower threshold pump command and the upper threshold pump command, the DI fuel pump compression chamber pressure may be maintained less than a DI fuel rail pressure but greater than a step-room pressure so that a pressure differential across the DI fuel pump piston may be sustained, wherein the pressure at the piston bottom is greater than the pressure at the piston top piston, to provide lubrication of the piston. In this way, pump noise may be substantially reduced while providing piston lubrication over a broad range of DI fuel rail pressures, even when fuel may not be pumped from the DI fuel pump to the DI fuel rail.

Accordingly, during PFI engine operating conditions, when the DI fuel pump status is conventionally OFF (e.g., solenoid activated check valve is de-energized), method 500 maintains a differential pressure across DI fuel pump piston in order to increase lubrication and reduce wear and degradation of DI fuel pump. Furthermore, method 500 commands DI fuel pump to $PC_{TH}$, where DI fuel pump would conventionally be OFF, to increase lubrication and reduce wear and degradation of DI fuel pump.

Furthermore, enforcing a DI fuel pump command signal greater than $PC_{TH}$ may increase lubrication of the DI fuel pump during transient conditions, when the DI fuel pump command signal would otherwise be less than $PC_{TH}$. As described above, $PC_{TH}$ may correspond to a pump command signal between a lower threshold pump command and an upper threshold pump command. In one example, the lower threshold pump command may comprise 5% and the upper threshold pump command may comprise 10%. Setting the DI fuel pump command signal to a threshold pump command, $PC_{TH}$, may include energizing solenoid activated check valve to adjust one or more of a current level, current ramp rate, a pulse-width, a duty cycle, or another modulation parameter of the fuel pump solenoid activated check valve to a threshold value.

For example, during direct injection of fuel, a pump command signal may be 50% duty cycle, and fuel may be supplied from DI fuel pump to the DI fuel rail; however, between pulse durations of the DI fuel pump duty cycle, the pump command signal may decrease below $PC_{TH}$ in conventional methods of DI fuel pump operation. At 570, controller 12 may enforce a DI fuel pump command signal greater than $PC_{TH}$ to increase DI fuel pump lubrication even in transient conditions where the DI fuel pump command signal may otherwise be less than $PC_{TH}$. In this way, method 500 may increase lubrication of DI fuel pump, reduce NVH, and reduce wear and degradation of DI fuel pump.

Turning now to FIG. 7, it illustrates a plot 700 of DI pump duty cycle versus direct injection fuel rail pressure. Timeline 710 represents a physical relationship between DI fuel pump duty cycle as a function of DI fuel rail pressure, which may be predetermined or can also be learned in real-time during engine operation. Timeline 710 illustrates that the DI fuel pump duty cycle increases with increasing DI fuel rail pressure. In other words, if a desired DI fuel rail pressure increases (e.g., for the case where an engine load is increases and an amount of direct-injected fuel is increased), the DI fuel pump duty cycle may be increased to supply the increased amount of direct-injected fuel and to increase the DI fuel rail pressure to the desired DI fuel rail pressure. Furthermore, if the DI fuel pump duty cycle maintained at or greater than the level indicated by timeline 710, the DI fuel pump will continue to supply fuel to the DI fuel rail. If the DI fuel pump duty cycle is lower than the level indicated by timeline 710, the DI fuel pump may not pump fuel into the DI fuel rail for direct injection since the DI fuel pump outlet pressure may be less than the DI fuel rail pressure. Furthermore, the fuel rail pressure may decrease as fuel is direct-injected because the direct-injected fuel is not replenished by the DI fuel pump until the DI fuel pump outlet pressure is greater than or equal to the DI fuel rail pressure.

Timeline 720 represents an example control operating line for maintaining lubrication of the DI fuel pump. Timeline 720 may represent a control operating line for a threshold pump command signal ($PC_{TH}$) that is intermediate between an upper threshold pump command 724 and a lower threshold pump command 722. The upper threshold pump command 724, the lower threshold pump command 722, and the threshold pump command control operating line 720 may all depend on DI fuel rail pressure in a similar manner to the dependence to timeline 720. By controlling the DI fuel pump to operate at control operating line 720 (e.g., maintaining operation of the DI fuel pump below timeline 710), lubrication of the DI fuel pump may be maintained even though the DI fuel pump may not pump fuel to the DI fuel rail. In this way, lubrication of the DI fuel pump may be increased, while reducing DI fuel pump degradation and NVH.

Conventional methods of reducing DI fuel pump command signal to 0% may reduce NVH but do not provide substantial lubrication to the DI fuel pump. Accordingly, DI fuel pump lubrication may be reduced, causing increased DI fuel pump degradation. By enforcing the DI fuel pump command signal to $PC_{TH}$ when the DI fuel pump command signal would otherwise conventionally be set to 0%, lubrication of the DI fuel pump may be increased, while reducing DI fuel pump degradation and NVH.

Returning now to FIG. 5, after 556 and 570, method 500 exits DI fuel pump lubrication 540 and continues at 580. At 580, method determines if port fuel injection (PFI) is ON. If PFI is ON, method 500 continues at 582 where the supply pressure of the LPP, $P_{LPP}$ is set to be greater than $P_{vap,fuel}+\Delta P_{TH}$, and greater than $P_{fuel,TH}$. In this way, fuel can be more reliably and continuously delivered to the PFI fuel rail for port fuel injection since $P_{LPP}>P_{fuel,TH}$, and fuel can be more reliably delivered to the DI fuel pump since $P_{LPP}>P_{vap,fuel}+\Delta P_{TH}$. If at 580, PFI is OFF, method 500 continues to 586 where $P_{LPP}$ is set to greater than $P_{vap,fuel}+\Delta P_{TH}$ so that fuel can be more reliably delivered to the DI fuel pump for direct fuel injection. After 582 and 586, method 500 ends.

In some examples, the LPP may be controlled via a feedback control scheme, where a fuel pressure in fuel passages downstream from the LPP are measured, and the LPP pump speed, outlet pressure, and the like are controlled accordingly. In Furthermore, in another example, the LPP may be controlled via an adaptive and/or integral control scheme. Based on the fuel volume injected from the DI fuel rail, the commanded fuel volume to be pumped via the LPP, and the amount of fuel stored in the DI fuel rail (e.g., indicated by the measured DI fuel rail pressure), a net fuel flow into the DI fuel rail may be determined. For example, an increase in DI fuel rail pressure may indicate a net accumulation of fuel in the DI fuel rail, whereas a decrease in DI fuel rail pressure may indicate a net loss of fuel from the DI fuel rail. By comparing the net fuel flow (or the fuel rail pressure) into the DI fuel rail with the corresponding commanded fuel volume to be pumped, the efficiency of the LPP may be determined. The LPP volumetric efficiency may be higher when the net fuel flow into the DI fuel rail may closely correspond to the commanded fuel volume to be pumped. If the LPP volumetric efficiency is lower, the net fuel flow into the DI fuel rail may not closely correspond to the commanded fuel volume to be pumped. In some examples the LPP efficiency may be low when the LPP delivery pressure is low, for example, $P_{LPP}$ may be less than a current fuel vapor pressure and cavitation at the DI fuel pump or in the fuel passage downstream from the LPP may occur. If the LPP efficiency is low, an adaptive controller may lower a DI pull-in current until the LPP volumetric efficiency increases and stabilizes. After 586, and 582, method 500 ends.

As described herein, an example of a method for a PFDI engine may be provided, comprising: during a first condition, including direct-injecting fuel to the PFDI engine, estimating a fuel vapor pressure, and setting a fuel lift pump pressure greater than an estimated fuel vapor pressure by a threshold pressure difference; and during a second condition, including port-fuel-injecting fuel to the PFDI engine, setting a DI fuel pump command signal greater than a threshold DI fuel pump command signal without supplying fuel to a DI fuel rail. Estimating the fuel vapor pressure may comprise switching off a fuel lift pump, measuring a fuel passage pressure compliance while direct-injecting fuel, and setting the fuel vapor pressure to a fuel passage pressure when the fuel passage pressure compliance is less than a threshold compliance. Measuring the fuel passage pressure compliance may comprise measuring a pressure compliance of a fuel passage fluidly coupled between the fuel lift pump the DI fuel pump. Estimating the fuel vapor pressure may comprise switching off the fuel lift pump, and setting the fuel vapor pressure to a fuel passage pressure after delivering a threshold fuel volume from a fuel passage fluidly coupled between the fuel lift pump and the DI fuel pump. The method may further comprise during the first condition, enforcing the DI fuel pump duty cycle greater than the threshold duty cycle. The first condition may further comprise only direct-injecting fuel to the PFDI engine. The method may further comprise during the second condition, maintaining DI pump lubrication by setting a DI fuel pump duty cycle between 5% and 10%. The method may further comprise during a third condition, maintaining DI fuel pump lubrication by setting a DI fuel pump duty cycle to 0%, the third condition comprising when an engine is idle. Maintaining DI fuel pump lubrication may comprise maintaining a DI fuel pump compression chamber pressure greater than a fuel lift pump pressure. The method may further comprise during the second condition, maintaining a DI fuel pump compression chamber pressure greater than a fuel lift pump pressure. The method may further comprise detecting a failed fuel lift pump check valve based on a fuel passage pressure decrease when the fuel lift pump is switched off.

As described herein, an example of a method of operating a fuel system for an engine may be provided, comprising: maintaining a fuel lift pump pressure greater than an estimated fuel vapor pressure while fuel is being direct-injected to the engine; and enforcing a duty cycle of a DI fuel pump to above a threshold duty cycle even when fuel is not being direct-injected to the engine. The estimated fuel vapor pressure may be calculated from a stabilized pressure in a fuel line, the pressure stabilizing while direct-injecting fuel after shutting off the fuel lift pump, wherein the fuel line is fluidly coupled between the fuel lift pump and the DI fuel pump. The method may further comprise, enforcing a DI fuel pump duty cycle to 0% during engine idling. The DI fuel pump duty cycle may be enforced to a 5% duty cycle when an engine load is above an idle engine load. The method may further comprise maintaining a fuel lift pump pressure greater than an estimated fuel vapor pressure while fuel is only being direct-injected to the engine. The method may further comprise enforcing a DI fuel pump duty cycle above 5% duty cycle while direct-injecting fuel to the engine. Enforcing the DI fuel pump duty cycle to above the threshold duty cycle may comprise maintaining a DI fuel pump compression chamber pressure greater than a fuel lift pump pressure.

Turning now to FIG. 6, it illustrates an example timeline 600 for engine operation. Timeline 600 includes timelines for PFI status 604, DI status 610, calibration condition status 620, fuel passage pressure compliance 630, fuel passage pressure 640, engine load 650, DI fuel pump command signal 660, DI fuel pump flow 670, LPP status 680, and DI fuel rail pressure 690. Also shown in timeline 600 are $Compliance_{TH}$ 634, current fuel vapor pressure $P_{vap,fuel}$ 644, $\Delta P_{TH}$ 646, $P_{vap,fuel}+\Delta P_{TH}$ 648, $P_{fuel,TH}$ 642, an engine idling load 654, and $PC_{TH}$ 664. When LPP status 680 is ON, fuel passage pressure 640 may be equivalent to $P_{LPP}$. When LPP status 680 is OFF, $P_{LPP}$ is zero, and may not equivalent to fuel passage pressure 640, when the fuel passage pressure 640 is greater than 0.

At time t0, PFI status changes from ON to OFF, DI status 610 changes from OFF to ON, and thus a calibration condition 620 is satisfied and a calibration condition changes from OFF to ON. In response to the calibration condition 620 changing from OFF to ON, the LPP power may be reduced below a threshold pump power. In the example timeline 600, the LPP status 680 is switched OFF in response to the calibration condition changing from OFF to ON.

Accordingly, after time t0 and prior to t1 a fuel vapor pressure calibration step may be performed, wherein a fuel passage pressure compliance 630 may be measured during DI fuel injection when the LPP is OFF or operating at reduced power below a threshold power. During the fuel vapor pressure calibration step, the fuel passage pressure 640 downstream of the LPP decreases as the DI fuel pump command signal 660 delivers fuel from the fuel passage to the DI fuel injection rail for direct injection to the engine while LPP is OFF. In response to the engine load 650 being higher, the DI fuel pump flow is higher, and a controller may enforce the DI fuel pump command signal 660 greater than $PC_{TH}$ 664, even in transient periods between injection pulses when the DI fuel pump command signal 660 would otherwise be zero. As shown in timeline 600, $PC_{TH}$ 664 may be higher based on when DI fuel rail pressure 690 is higher, and $PC_{TH}$ 664 may be lower in response to the DI fuel rail pressure 690 being lower. Operation of the engine in this manner may aid in increasing lubrication of the DI fuel pump, reducing NVH, wear, and degradation thereof. Further still, fuel passage pressure compliance may be greater than $Compliance_{TH}$, indicating that the fuel passage pressure is greater than actual fuel vapor pressure 644.

At time t1, the fuel passage pressure 640 decreases to actual fuel vapor pressure 644. Consequently, the fuel passage pressure compliance 630 decreases below $Compliance_{TH}$, and in response, a calibration condition 620 is switched OFF. Furthermore an estimated fuel vapor pressure, $P_{vap,fuel}$, is set to the current fuel passage pressure. The duration of the fuel vapor calibration period (e.g., from t0 to t1) may be long enough to determine a fuel vapor pressure, but brief enough so as not to reduce or starve fuel injection to the engine. Furthermore, during the duration of the fuel vapor calibration period, at least a threshold volume of fuel may be delivered from the fuel passage by the DI fuel pump while the LPP is OFF.

Shortly thereafter at time t2 (after the fuel vapor pressure calibration step has completed), the LPP status is restored to ON. In response, the fuel passage pressure 640 increases to match the supply pressure of the LPP as the fuel passage is filled with fuel, and the fuel passage pressure compliance returns to its typical level. After t2, because DI fuel injection remains ON, the DI fuel pump command signal is enforced greater than $PC_{TH}$ to maintain DI pump lubrication while reducing NVH. Furthermore, $P_{LPP}$ is set to be just greater than $P_{vap,fuel}+\Delta P_{TH}$, as reflected by the fuel passage pressure being just greater than $P_{vap,fuel}+\Delta P_{TH}$ to reduce cavitation. Furthermore, by determining the current fuel vapor pressure, $P_{LPP}$ may be controlled at a lower pressure while reducing cavitation. In this way, fuel economy may be enhanced and LPP degradation may be reduced.

At time t3, PFI is switched ON, and $P_{LPP}$ (as represented by fuel passage pressure 640) is controlled to be greater than $P_{vap,fuel}+\Delta P_{TH}$ and greater than $P_{fuel,TH}$. In this way, cavitation in the fuel passage and at DI fuel pump may be reduced, while continuously delivering fuel to the PFI fuel rail for port fuel injection. Furthermore, engine load decreases, and $PC_{TH}$ decreases in response to the DI fuel rail pressure 690 decreasing. However, DI fuel pump command 660 is enforced above $PC_{TH}$ to maintain DI fuel pump lubrication while reducing NVH and DI fuel pump degradation.

At time t4, DI status is switched OFF. LPP status remains ON, and $P_{LPP}$ is maintained greater than $P_{fuel,TH}$ to continuously deliver fuel to the PFI fuel rail for port fuel injection. Furthermore, engine load continues to decrease, and $PC_{TH}$ continues decrease in response to the DI fuel rail pressure 690 decreasing. However, enforcing of DI fuel pump command 660 above $PC_{TH}$ is maintained to provide DI fuel pump lubrication while reducing NVH and DI fuel pump degradation.

At time t5, the engine load 650 decreases to idle (e.g., a vehicle comes to a stop) while PFI status remains ON, and DI status 610 remains OFF. In response to the engine idling and the PFI status being ON (e.g., PFI idle conditions), the DI fuel pump command signal 660 is set to 0% (below $PC_{TH}$), maintaining no DI fuel pump flow. Setting the DI fuel pump command signal 660 to 0% de-energizes solenoid activated check valve to pass through mode. As such, lubrication of DI fuel pump piston may be provided even when DI injection is OFF, the engine is idle, and a DI fuel pump command signal is 0%. Between t5 and t6, during PFI idle conditions, $P_{LPP}$, and the fuel passage pressure, are maintained greater than $P_{fuel,TH}$ to provide continuous supply of fuel to the PFI fuel rail.

Next at time t6, the engine load 650 increases above idle load (e.g., a vehicle tip-in). In response, DI fuel pump command signal 660 is increased from 0% to greater than $PC_{TH}$ to provide lubrication to the DI fuel pump piston, without supplying fuel flow to the DI fuel rail. As such, wear and degradation of DI fuel pump may be reduced in addition to NVH. Furthermore, because PFI is ON and DI status is OFF, $P_{LPP}$, and the fuel passage pressure, are maintained greater than $P_{fuel,TH}$ to provide continuous supply of fuel to the PFI fuel rail.

At time t7, in response to an engine load increasing to a higher level (e.g., vehicle accelerating from low speeds), a PFI status is switched OFF while a DI status is switched ON. In response, the DI fuel pump command signal is maintained greater than $PC_{TH}$ to ensure lubrication of the DI fuel pump piston, even during transient periods where the DI fuel pump command would be less than $PC_{TH}$ otherwise. Furthermore, in response to the DI status switching from OFF to ON, a calibration condition 620 becomes satisfied at time t7. Thus, between times t7 and t8, the LPP control mode is switched OFF, and a fuel passage pressure begins to decrease as the DI fuel pump delivers fluid from the fuel passage, pumping fuel to the DI fuel rail.

At time t8, a fuel passage pressure decreases to actual fuel vapor pressure 644 and the fuel passage pressure compliance 630 decreases below $Compliance_{TH}$. Timeline 600 shows that current fuel vapor pressure has increased relative to the fuel vapor pressure determined at time t2. As an example, the fuel vapor pressure may have increased because the fuel system temperature has increased due to the engine being warmed. Thus $P_{vap,fuel}$ 644 is set to the fuel passage pressure at t8 to provide an updated estimate of the current fuel vapor pressure. At time t8, the fuel passage pressure compliance 630 also decreases below $Compliance_{TH}$, and in response, a calibration condition 620 is switched OFF. In response to the calibration condition being switched OFF, DI fuel pump command signal 660 is enforced greater than $PC_{TH}$, thereby maintaining DI fuel pump piston lubrication while supply fuel flow to the DI fuel rail.

At time t9, the LPP is switched ON. Furthermore, DI fuel pump command signal 660 is enforced greater than $PC_{TH}$, thereby maintaining DI fuel pump piston lubrication while supply fuel flow to the DI fuel rail. Further still, $P_{LPP}$ is maintained greater than $P_{vap,fuel}+\Delta P_{TH}$ since PFI is OFF.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, -I4, -I6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for a PFDI engine, comprising:

during a first condition, including direct-injecting fuel to the PFDI engine, estimating a fuel vapor pressure, and setting a fuel lift pump pressure greater than an estimated fuel vapor pressure by a threshold pressure difference; and during a second condition, including port-fuel-injecting fuel to the PFDI engine, setting a DI fuel pump command signal greater than a threshold DI fuel pump command signal without supplying fuel to a DI fuel rail.

2. The method of claim 1, wherein estimating the fuel vapor pressure comprises switching off a fuel lift pump, measuring a fuel passage pressure compliance while direct-injecting fuel, and setting the fuel vapor pressure to a fuel passage pressure when the fuel passage pressure compliance is less than a threshold compliance.

3. The method of claim 2, wherein measuring the fuel passage pressure compliance comprises measuring a pressure compliance of a fuel passage fluidly coupled between the fuel lift pump the DI fuel pump.

4. The method of claim 1, wherein estimating the fuel vapor pressure comprises switching off the fuel lift pump, and setting the fuel vapor pressure to a fuel passage pressure after delivering a threshold fuel volume from a fuel passage fluidly coupled between the fuel lift pump and the DI fuel pump.

5. The method of claim 1, further comprising during the first condition, enforcing the DI fuel pump duty cycle greater than the threshold duty cycle.

6. The method of claim 1, wherein the first condition further comprises only direct-injecting fuel to the PFDI engine.

7. The method of claim 1, further comprising during the second condition, maintaining DI pump lubrication by setting a DI fuel pump duty cycle between 5% and 10%.

8. The method of claim 1, further comprising during a third condition, maintaining DI fuel pump lubrication by setting a DI fuel pump duty cycle to 0%, the third condition comprising when an engine is idle.

9. The method of claim 8, wherein maintaining DI fuel pump lubrication comprises maintaining a DI fuel pump compression chamber pressure greater than a fuel lift pump pressure.

10. The method of claim 1, further comprising during the second condition, maintaining a DI fuel pump compression chamber pressure greater than a fuel lift pump pressure.

11. The method of claim 1, further comprising detecting a failed fuel lift pump check valve based on a fuel passage pressure decrease when the fuel lift pump is switched off.

12. A method of operating a fuel system for an engine, comprising:

maintaining a fuel lift pump pressure greater than an estimated fuel vapor pressure while fuel is being direct-injected to the engine; and enforcing a duty cycle of a DI fuel pump to above a threshold duty cycle even when fuel is not being direct-injected to the engine.

13. The method of claim 12, wherein the estimated fuel vapor pressure is calculated from a stabilized pressure in a fuel line, the pressure stabilizing while direct-injecting fuel after shutting off the fuel lift pump, wherein the fuel line is fluidly coupled between the fuel lift pump and the DI fuel pump.

14. The method of claim 12, further comprising, enforcing a DI fuel pump duty cycle to 0% during engine idling.

15. The method of claim 12, wherein the DI fuel pump duty cycle is enforced to a 5% duty cycle when an engine load is above an idle engine load.

16. The method of claim 12, further comprising maintaining a fuel lift pump pressure greater than an estimated fuel vapor pressure while fuel is only being direct-injected to the engine.

17. The method of claim 12, further comprising enforcing a DI fuel pump duty cycle above 5% duty cycle while direct-injecting fuel to the engine.

18. The method of claim 12, wherein enforcing the DI fuel pump duty cycle to above the threshold duty cycle comprises maintaining a DI fuel pump compression chamber pressure greater than a fuel lift pump pressure.

19. An engine system, comprising:

a PFDI engine;

a DI fuel pump;

a fuel lift pump; and a controller, comprising executable instructions to:

during a first condition, comprising direct-injecting fuel to the PFDI engine, estimating a fuel vapor pressure, and setting a pressure of the fuel lift pump greater than the fuel vapor pressure by a threshold pressure difference; and during a second condition, comprising port-fuel-injecting fuel to the PFDI engine, setting a DI fuel pump duty cycle to a threshold duty cycle without supplying fuel to a DI fuel rail.

20. The engine system of claim 19, further comprising, during the first condition, when a desired lift pump pressure is greater than the fuel vapor pressure, controlling the lift pump pressure via feedback control, and when the desired lift pump pressure is less than the fuel vapor pressure, controlling the fuel lift pump to supply the pressure equivalent to the fuel vapor pressure plus the threshold pressure difference.

* * * * *